United States Patent [19]

Kawaguchi et al.

[11] Patent Number: 4,952,902

[45] Date of Patent: Aug. 28, 1990

[54] THERMISTOR MATERIALS AND ELEMENTS

[75] Inventors: Yukio Kawaguchi; Tohru Kineri, both of Chiba, Japan

[73] Assignee: TDK Corporation, Tokyo, Japan

[21] Appl. No.: 421,771

[22] Filed: Oct. 16, 1989

Related U.S. Application Data

[63] Continuation of Ser. No. 169,041, Mar. 16, 1988.

[30] Foreign Application Priority Data

| | | | |
|---|---|---|---|
| Mar. 17, 1987 | [JP] | Japan | 62-61996 |
| Nov. 20, 1987 | [JP] | Japan | 62-294797 |
| Nov. 20, 1987 | [JP] | Japan | 62-294798 |
| Dec. 2, 1987 | [JP] | Japan | 62-305327 |
| Feb. 17, 1988 | [JP] | Japan | 63-34733 |

[51] Int. Cl.[5] ..... H01C 7/10

[52] U.S. Cl. ..... 338/22 R; 264/61; 252/516

[58] Field of Search ..... 338/22 R, 22 SD, 25; 219/543, 548; 264/56, 60, 61, 104, 105; 252/516

[56] References Cited

FOREIGN PATENT DOCUMENTS

| | | |
|---|---|---|
| 55-116667 | 9/1980 | Japan . |
| 57-22173 | 2/1982 | Japan . |
| 57-91065 | 5/1983 | Japan . |
| 58-151370 | 9/1983 | Japan . |
| 60-246266 | 12/1985 | Japan . |
| 60-246267 | 12/1985 | Japan . |
| 60-253202 | 12/1985 | Japan . |

OTHER PUBLICATIONS

CRC Handbook of Chemistry and Physics, 66th Edition, 1985, CRC Press, Inc., p. B-77.

Kingery, W. D., Introduction to Ceramics, Wiley & Sons, Inc., 1960, pp. 416-417.

*Primary Examiner*—Bruce A. Reynolds

*Assistant Examiner*—M. Lateef

*Attorney, Agent, or Firm*—Oblon, Spivak, McClelland, Maier & Neustadt

[57] ABSTRACT

A thermistor material comprising, in sintered form, (A) a matrix comprising aluminum oxide, silicon oxide, or the oxide of an element belonging to Group 2A in the Periodic Table, and (B) a conductive path forming substance comprising silicon carbide and/or boron carbide, wherein the volume ratio of silicon carbide to the matrix is up to about 1.24 is stable at elevated temperatures of 400°-800° C.

12 Claims, 8 Drawing Sheets

THERMISTOR MATERIALS AND ELEMENTS

This is a continuation of application Ser. No. 169,041, filed on Mar. 16, 1988.

BACKGROUND OF THE INVENTION

1. Field of the Invention

This invention relates to thermistor materials and thermistor elements. More particularly, it relates to thermistor materials suitable to form a thermistor element having a negative temperature coefficient of resistance for use at elevated temperatures.

2. Discussion of the Prior Art

Thermistors are temperature sensors which make use of the temperature dependency of electric resistance of a temperature-sensitive resistor and are widely used in measurement and control of temperature. For high temperature applications, thermistors are used as sensors for detecting the temperature of automobile exhaust gases or the temperature of electric ovens.

Materials that form temperature-senstive resistors of high-temperature thermistor elements, that is, thermistor materials are generally sintered bodies of composite oxides including fluorspar (zirconia series such as $ZrO_2$-CaO-$Y_2O_3$-$Nd_2O_3$-ThO), spinel (such as MgO-NiO-$Al_2O_3$-$Cr_2O_3$-$Fe_2O_3$, CoO-MnO-NiO-$Al_2O_3$-$Cr_2O_3$-$CaSiO_3$, $NiO_2$-CoO-$Al_2O_3$, and MgO-$Al_2O_3$-$Cr_2O_3$-$LaCrO_3$), corundum (such as $Al_2O_3$-$Cr_2O_3$-$MnO_2$-CaO-$SiO_2$), perovskite and rutile structure composite oxides.

The thermistor materials based on these sintered composite oxides experience substantial changes with a lapse of time and are thus unstable for the reason that they have a crystal transformation point of lower than 1,000° C. and barriers are formed between grains. Particularly, zirconia type sintered oxides experience greater changes with a lapse of time because they are oxygen ion conductors which invite redox reaction. These thermistor materials are inconsistent in resistance and performance because they are composites consisting of multiple oxides. Since these thermistor materials have a high thermistor constant B and hence, a too high temperature coefficient of resistance, thermistors formed thereof cannot cover a wide temperature range from room temperature to high temperatures. These thermistors cannot be used at temperatures of higher than 500° C.

Another type of thermistor element is known in the art which uses thermistor materials based on silicon carbide and boron carbide. For example, Japanese Patent Publication No. 42-19061 discloses a thermistor element comprising monocrystalline silicon carbide having a minor amount of an element of Group 3B or 5B in the Periodic Table added as a p- or n-type impurity. This element suffers from low productivity and high manufacturing cost because monocrystalline silicon carbide must be formed. Although the element shows a very stable electric resistance at elevated temperatures, it undergoes surface oxidation when used in air at elevated temperatures, particularly at 400° C. or higher. A protective film is necessary to prevent surface oxidation. The most preferred method for forming a protective film is encapsulation of a chip with glass because of ease of operation. However, the thermistor element based on monocrystalline silicon carbide tends to undergo foaming during glass encapsulation due to reaction of silicon carbide with glass. It is thus very difficult to encapsulate the element with glass.

U.S. Pat. No. 4,086,559 discloses a thermistor element comprising a pyrolyzed polycrystalline isometric silicon carbide having at most 0.7% by volume of a p-type impurity added thereto.

U.S. Pat. Nos. 4,359,372 and 4,424,507 disclose sputtered thin-film thermistor elements comprising silicon carbide or boron carbide containing a minor amount of an impurity. These thin-film thermistors suffer from low productivity and high manufacturing cost as the monocrystalline thermistors do. Glass encapsulation is substantially impossible. In the sputtered thin film of the latter patent, glass is vapor deposited to form a protective film in order to suppress foaming at the sacrifice of productivity.

Composite sintered bodies based on oxide materials and non-oxide materials are also known in the art. These are higher in productivity than the monocrystalline and thin-film thermistor materials. Among the composite sintered bodies are included the following silicon carbide-based materials.

(a) A sintered polycrystalline silicon carbide body comprising a major proportion of silicon carbide and up to 20% by weight, calculated as element, of Be, BeO, B, $B_2O_3$, BN or $B_4C$ (see U.S. Pat. No. 4,467,309)

(b) A polycrystalline sintered body comprising silicon carbide and 0.5 to 10% by weight of at least one member selected from aluminum and aluminum compounds such as aluminum oxide (see Japanese Patent Application Kokai No. 60-49607).

(c) A sintered silicon carbide body comprising silicon carbide having a minor amount of boron thermally diffused therein (see Japanese Patent Publication No. 60-52562).

These silicon carbide-based materials, however, are difficult to encapsulate with glass because the increased content of SiC incurs foaming. The silicon carbide-based materials are difficult to machine and thus difficult to cut into thermistor chips.

These thermistor materials also have the drawback that they have a thermistor constant B as high as 10,000K or more and hence, a too high temperature coefficient of resistance, and thus fail to cover a wide temperature range.

A study on the resistivity ($\rho$) of thermistor material in relation to the ratio of components thereof reveals that the resistivity largely changes with a small change of component ratio. It is thus difficult to control the resistance of thermistor material.

Japanese Patent Application Kokai No. 55-140201 discloses a thick-film thermistor comprising a major proportion of SiC, 2 to 15% by weight of $RuO_2$, and 20 to 50% by weight of glass. It is very difficult to control severe foaming which takes place due to reaction between powder silicon carbide and glass during printing and sintering.

Japanese Patent Application Kokai No. 60-37101 discloses a sintered material comprising silicon carbide and silicon nitride combined with a semiconductor oxide such as zirconium oxide, nickel oxide, zinc oxide, cobalt oxide, chromium oxide and titanium oxide. Also disclosed is a sintered material comprising aluminum oxide and zirconium combined with a nitride, boride, carbide or silicide of a transition element of Group 3A, 4A, 5A and 6A in the Periodic Table.

The sintered materials comprising silicon carbide and silicon nitride combined with a semiconductor oxide have several problems. (i) Since the semiconductor oxide is readily reduced during sintering, control of electric resistance is difficult. The materials tend to be affected by the ambient atmosphere because of the presence of oxygen defects. (ii) A choice of sintering conditions for composite material is difficult because the semiconductor oxides have a low sintering temperature as compared with silicon carbide and silicon nitride. (iii) Since the electric resistance is considerably lowered as a result of reduction of semiconductor oxide as described in (i), it is difficult to obtain a resistivity of several tens Ω-cm at 500° C. In order to obtain a thermistor element having a resistance of $10^3$ to $10^6$ ohm as commonly used in thermistor circuits, the distance between electrodes must be increased at the sacrifice of compactness and quick response.

The sintered materials comprising aluminum oxide and zirconium oxide combined with a nitride, boride, carbide or silicide of a transition element of Group 3A, 4A, 5A or 6A are difficult to control their electric resistance. Since the nitrides, borides, carbides and silicides of transition elements of Group 3A, 4A, 5A and 6A are approximate electrical conductors, composite materials thereof with aluminum oxide and zirconium oxide drastically change their electric resistance with a slight change of composition.

Further, Japanese Patent Application Kokai No. 60-37101 discloses several thermistor material compositions. One typical example is 36%SiC-7%$B_4C$-55%CoO-2%$Li_2O$ (expressed in % by weight) in which Li tends to diffuse upon application of voltage and Co is unstable at about 500° C. Since this composition has a resistivity of up to 60Ω-cm at 500° C., the electrode-to-electrode distance cannot be reduced, which is undesired for compactness. Other examples are 3.7%SiC-20%$Al_2O_3$-35%$TiO_2$-8%$Ta_2O_3$ and one prepared by adding 9 parts by weight of $TiO_2$ to 11 parts by weight of 65%SiC-35%$Al_2O_3$. Titanium oxide which is present in a volume ratio of $TiO_2$ to SiC of more than ½ is reduced into a conductor by SiC and the sintering atmosphere. The material is thus difficult to control its resistance and its resistance at 500° C. is unstable. Other composite sintered bodies disclosed therein are prepared by combining at least one member of SiC, $Si_3N_4$, $Al_2O_3$, and $ZrO_2$ with at least one member of NiO, ZnO, CoO, $Cr_2O_3$, and $TiO_2$. These materials have a problem that semiconductor metal oxides are susceptible to reduction by carbide and the ambient atmosphere, have a low electric resistance, or tend to change their valence at a temperature of higher than about 500° C.

SUMMARY OF THE INVENTION

Therefore, a primary object of the present invention is to provide a novel and improved thermistor material which is stable at elevated temperatures as high as about 400° C. to about 800° C.

Another object of the present invention is to provide a novel and improved thermistor material which is easy to control its resistance and to encapsulate with glass.

A further object of the present invention is to provide a thermistor element having improved performance, particularly at elevated temperatures.

According to the present invention, there is provided a thermistor material comprising, in sintered form, (A) a matrix comprising at least one oxide selected from the group consisting of oxides of aluminum, silicon, and the elements belonging to Group 2A in the Periodic Table, and (B) a conductive path forming substance comprising at least one carbide selected from the group consisting of silicon carbide and boron carbide, wherein the volume ratio of silicon carbide to the matrix is up to about 1.24.

Preferably, the sintered body has a density of at least about 75% of the theoretical density.

Preferably, the matrix further comprises at least one of the oxides of elements belonging to Group 4A in the Periodic Table such that the volume ratio of the Group 4A element oxide to the silicon carbide and boron carbide is up to about ½.

Preferably, the thermistor material further comprises (C-1) an element belonging to Group 2A in the Periodic Table in elemental or carbide form in an amount of from about 0.01 to about 10% by weight, (C-2) an element belonging to Group 3A in elemental, oxide or carbide form in an amount of about 0.01 to about 10% by weight, (C-3) an element belonging to Group 4A in elemental or carbide form in an amount of about 0.01 to about 10% by weight, or (C-4) iron in elemental, oxide or carbide form in an amount of about 0.01 to about 10% by weight, or a mixture thereof, all percents being based on the thermistor material and calculated in elemental form.

The present invention also provides a thermistor element comprising a thermistor chip formed of a thermistor material as defined above.

BRIEF DESCRIPTION OF THE DRAWINGS

The above and other objects, features, and advantages of the present invention will be better understood from the following description taken in conjunction with the accompanying drawings, in which.

DETAILED DESCRIPTION OF THE INVENTION

Figure 1:
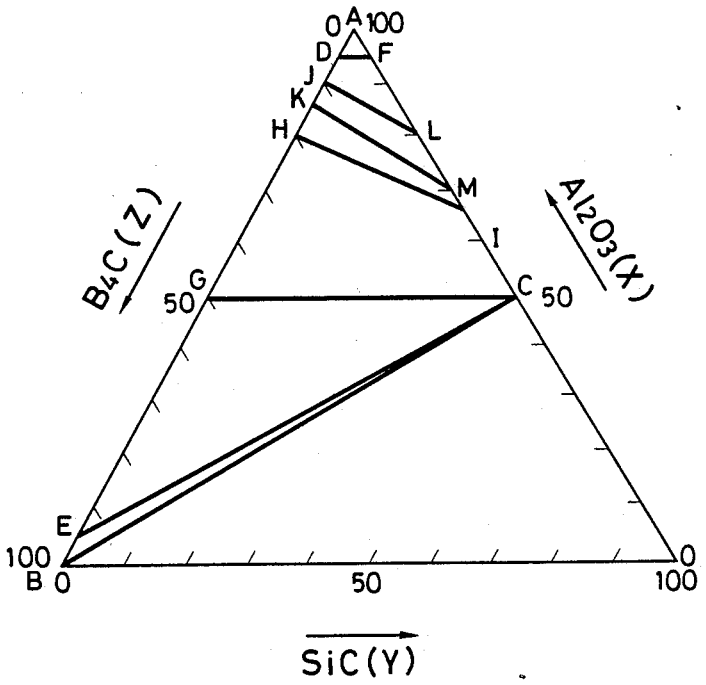
FIG. 1 is a phase diagram illustrating the composition of $Al_2O_3$-$B_4C$-SiC system as one embodiment of the thermistor material of the present invention.

The thermistor material of the present invention is a sintered body comprising (A) an oxide matrix and (B) a conductive path forming substance which is selected from silicon carbide, boron carbide and mixtures thereof. Silicon carbide is present in the material such that the volume ratio of silicon carbide to matrix is up to about 1.24. With a volume ratio of more than about 1.24, the resistance of the material is lowered and foaming takes place in a subsequent glass encapsulating step as will be described later, rendering it difficult to fabricate a thermistor element by glass encapsulation.

Irrespective of whether silicon carbide is used alone or a mixture of silicon carbide and boron carbide is used, the volume ratio of silicon carbide to matrix is up to about 1.24. Insofar as the volume ratio of silicon carbide to matrix ranges from 0 to about 1.24, the ratio of silicon carbide to boron carbide is not particularly limited and ranges from 1:0 to 0:1.

The volume ratio of silicon carbide or boron carbide to matrix may be determined by cutting a sintered body, mirror finishing the section, observing the section under a microscope, determining the surface areas of the respective components, and calculating the ratio of surface areas which is equal to the volume ratio.

Silicon carbide which is present in the sintered body of the present invention is represented by chemical formula SiC, but may have a composition deviating more or less from its stoichiometry. Silicon carbide generally has an average grain size of from about 0.1 to about 15 μm.

Boron carbide which is present in the sintered body of the present invention is represented by chemical formula $B_4C$, but may have a composition deviating more or less from its stoichimetry. Boron carbide generally has an average grain size of from about 0.1 to about 15 μm.

The matrix is preferably at least one oxide in sintered form selected from the group consisting of oxides of aluminum, silicon, and elements belonging to Group 2A in the Periodic Table and mixtures thereof. The use of matrix in the form of sintered oxide minimizes foaming upon glass encapsulation. Typical examples of the matrix oxide is aluminum oxide $Al_2O_3$, particularly $\alpha$-$Al_2O_3$, and silicon oxide $SiO_2$. Also included are mixtures of aluminum oxide and silicon oxide in varying ratio. The use of silicon oxide improves machinability and facilitates chip fabrication.

The oxide of an element belonging to Group 2A in the Periodic Table may also be used in addition to or instead of aluminum oxide and/or silicon oxide. The use of Group 2A element oxide renders it easy to control the electric resistance of thermistor material, minimizes a local variation of electric resistance in a sintered body wafer, and improves machinability.

The Group 2A elements include Be, Mg, Ca, Sr and Ba. Preferred, but non-limiting examples of the oxides of Group 2A elements include magnesium oxide MgO, calcium oxide CaO, strontium oxide SrO, and barium oxide BaO. These oxides of Group 2A elements may be used in a proper amount in the range of from 0 to 100% by weight of the matrix, depending on the desired electric resistance.

In addition to the oxide of Al, Si or a Group 2A element or a mixture thereof, the matrix may contain at least one oxide of an element belonging to Group 4A in the Periodic Table. The presence of Group 4A element oxide improves control of electric resistance, local variation of electric resistance in the sintered body, and machinability. Group 4A includes Ti, Zr and Hf, and preferred examples of Group 4A element oxide are titanium oxide $TiO_2$ and zirconium oxide $ZrO_2$. The Group 4A element oxide is present in such an amount that the volume ratio of Group 4A element oxide to silicon carbide and boron carbide is up to about ½ preferably up to about 3/10. It is undesirable that the Group 4A element oxide is present in an amount to give an oxide-to-carbide volume ratio of more than ½, because the oxide is reduced into a corresponding metal by SiC or $B_4C$ during sintering. Since the resulting metal is conductive, SiC and $B_4C$ cannot play a main role to form a conductive path, detracting from thermistor performance at elevated temperatures and stability thereof.

Illustrative, non-limiting examples of the sintered oxide of which the matrix is comprised include aluminum oxide $\alpha$-$Al_2O_3$, silicon dioxide $SiO_2$, mullite $3Al_2O_3.2SiO_2$, steatite $MgO.SiO_2$, forsterite $2MgO.SiO_2$, zircon $ZrO_2.SiO_2$, porcelain $SiO_2Al_2O_3$, magnesia MgO, $Al_2O_3.CaO$, $Al_2O_3.TiO_2$, and $BaO.SiO_2$. These and other composite oxides are described in "Engineering Properties of Ceramics-Databook to Guide Materials Selection for Structural Applications", Battele Memorial Institute Columbus Laboratories, pp 445–447, 459, 469, 472, and 479–480. These sintered oxides have the chemical formulae shown above, but may have a composition deviating more or less from their stoichiometry. The sintered oxides generally have an average grain size of from about 0.1 to about 100 μm, preferably from about 0.1 to about 10 μm.

In the sintered body of the present invention, silicon carbide or boron carbide or a mixture of silicon carbide and boron carbide functions to form a conductive path in the matrix for the sintered body to exhibit thermistor performance. The conductive path formed by the carbide is stable at temperatures as high as 400° C. or higher so that excellent thermistor performance is expectable.

One embodiment of the present invention wherein aluminum oxide $\alpha$-$Al_2O_3$ is used as the sintered oxide or matrix is described in detail. The composition is expressed in % by weight by subjecting the sintered body to chemical analysis to determine the contents of respective components.

Assuming that the contents of aluminum oxide, silicon carbide and boron carbide are x, y and z % by weight, respectively, based on $x+y+z=100\%$ by weight, the contents of aluminum oxide, silicon carbide and boron carbide (x, y and z) are plotted in the ternary diagram of FIG. 1. According to the present invention, the composition of sintered body falls within the region enclosed by lines connecting A (100, 0, 0), B (0, 0, 100) and C (50, 50, 0), excluding points A and B, as shown in FIG. 1. The composition preferably falls within the region enclosed by lines connecting D (95, 0, 5), E (5, 0, 95), C (50, 50, 0), and F (95, 5, 0), more preferably within the region enclosed by lines connecting D (95, 0, 5), G (50, 0, 50), C (50, 50, 0), and F (95, 5, 0), and most preferably within the region enclosed by lines connecting D (95, 0, 5), H (80, 0, 20), I (65, 35, 0), and F (95, 5, 0).

The reason why the composition of sintered body should fall within the above region will be described. At point A (100, 0, 0) in FIG. 1, which means that a sintered body consists of 100% by weight of aluminum oxide or matrix, the sintered body exhibits a high resistance even at high temperatures. At point B (0, 0, 100) in FIG. 1, which means that a sintered body consists of 100% by weight of boron carbide, it is difficult to obtain a sintered body. Compositions falling below line BC result in thermistor elements having a higher B constant and are difficult to form a sintered body.

Compositions falling below line DF are successful in achieving a desired resistance as a result of addition of $B_4C$ and/or SiC. Compositions falling above line EC are improved in sinterability and can be sintered into excellent thermistor chips.

Compositions falling above line GC and having an $Al_2O_3$ content of at least 50% by weight are more improved in sinterability.

One result of the addition of $B_4C$ and/or SiC is a reduction of the resistance of $Al_2O_3$ or matrix. This resistance reducing effect is obtained in the region enclosed by DGCF. The resistance gradually lowers with the increasing content of $B_4C$ and/or SiC within this region. Resistance change is saturated when the composition exceeds line GC. That is, the resistance is reduced no longer with compositions beyond line GC.

Within the region enclosed by GEC, compositions can generally be used as thermistor. Even within this region, however, certain raw materials will give a composition which has a too low resistance and is thus not useful as thermistor. Compositions falling above line GC are preferred in that no limitation is imposed on raw materials and the desired resistance is obtained by choosing a proper composition.

More particularly, silicon carbide (SiC) raw material usually contains such impurities as O, Al, Fe, and Ti in addition to free C and Si. With a raw material containing at least about 99% by weight of SiC, a saturated resistance of at least about $10^4$ Ω-cm is available and compositions falling within the region enclosed by GCE may be used. With raw materials having a lower purity, the resulting compositions fall below line GC and have a lower resistance. Boron carbide ($B_4C$) raw material usually contains such impurities as O, N and Fe. With a raw material containing at least about 99% by weight of $B_4C$, a saturated resistance of at least about $10^4$ Ω-cm is available and compositions falling within the region enclosed by GCE may be used. With raw materials having a lower purity, the resulting compositions fall below line GC and have a lower resistance.

Better resistances are available within the region enclosed by DHIF, and best resistances are available in the region enclosed by lines connecting J (90, 0, 10), K (85, 0, 15), L (80, 20, 0), and M (70, 30, 0).

The foregoing describes the preferred range of a composition comprising $\alpha$-$Al_2O_3$ alone as the matrix in terms of the contents x, y and z of $\alpha$-$Al_2O_3$, SiC and $B_4C$.

The same is applicable to embodiments wherein the $\alpha$-$Al_2O_3$ is replaced by another matrix material, provided that the matrix, SiC and $B_4C$ are present in amounts of $Ax.\rho m/\rho a$, Ay and Az parts by weight wherein the other matrix material has a theoretical density $\rho m$ and $\alpha$-$Al_2O_3$ has a theoretical density $\rho a$, and $A=100/(\rho m.x/\rho a+y+z)$. Preferred contents of the respective components are given by the regions defined by points ($Ax.\rho m/\rho a$, Ay, Az) corresponding to points A through M (x, y, z) in FIG. 1.

The theoretical density of respective components is described in the above-incorporated literature of Battele Memorial Institute Columbus Laboratories and can be readily calculated therefrom. Specifically described, $\alpha$-$Al_2O_3$ has a theoretical density $\rho a$ of 3.98 g/cm$^3$, $B_4C$ has a theoretical density of 2.52 g/cm$^3$, SiC has a theoretical density of 3.21 g/cm$^3$, and $2MgO.SiO_2$ has a theoretical density of 3.71 g/cm$^3$.

The sintered body of the present invention has a volume ratio of silicon carbide/matrix of up to 1.24 and preferably has the above-described composition expressed in % by weight.

The actual density of the sintered body is preferably at least about 75%, more preferably from 90% to 100%, most preferably from 95% to 100% of the theoretical density. The variation of electric resistance of a thermistor element with time is then minimized.

In the sintered body of the present invention, part of silicon carbide and boron carbide may be converted to corresponding oxides, silicon oxide and boron oxide during sintering. Conversely, part of the matrix oxides may be converted to carbides. It is desired that the content of boron oxide is limited to 0 to about 1% by weight, preferably from about 0.1 to about 0.5% by weight because boron oxide, particularly $B_2O_3$ vitrifies and thus add to the vitreous phase to lower the overall melting point, rendering it difficult to control the electric resistance and grain size of a sintered body.

Preferably, the thermistor material of the present invention comprising (A) the oxide matrix and (B) the conductive path forming substance in the form of silicon carbide and/or boron carbide as described above may further include (C) an auxiliary ingredient selected from the elements belonging to Group 3A, preferably in an amount of about 0.01 to about 10% by weight calculated in elemental form. These elements may be contained either as an elemental metal or compound or a mixture thereof.

Preferred Group 3A elements are Y and Ce. Preferred compounds of these elements are oxides, for example, $Y_2O_3$ and $CeO_2$ and carbides. The presence of the Group 3A element in an amount of about 0.01 to about 10% by weight calculated in elemental form makes it easy to control the electric resistance of a sintered body and minimizes the local variation of electric resistance in a sintered body wafer.

In addition to or instead of the Group 3A element, the thermistor material of the present invention may contain iron as another auxiliary ingredient (C), preferably in metallic, oxide ($Fe_2O_3$) or carbide form or a mixture thereof. Iron has a similar effect to the Group 3A elements. The content of iron preferably ranges from about 0.01 to about 10% by weight of the thermistor material calculated in elemental form.

It is to be noted that the addition of Group 8 elements other than iron, for example, Co, Ni, and Ru results in a sintered body in which the amount of oxygen defects is likely to vary at a service temperature of 500° C. or higher. The electric resistance deteriorates with time particularly when the content of such an element other than iron is increased. For this reason, the addition of Group 8 elements other than iron in elemental, oxide or carbide form is not excluded, but is preferably limited to an amount of up to 1% by weight, more preferably 0 to about 0.5% by weight calculated in elemental form.

A similar effect is achieved with the oxides of Group 2A and 4A elements as previously described in conjunction with the matrix. Their preferred content ranges from the entirety to part of the matrix as previously described and is preferably at least 0.01% by weight calculated in elemental form. Preferred Group 2A and 4A elements are Mg, Ca, Sr, Ba, Ti and Zr. The Group 2A and 4A elements may also be present in elemental or carbide form or as a mixture thereof, preferably in an amount of about 0.01 to about 10% by weight calculated in elemental form because of ease of control and minimized variation of electric resistance.

The thermistor material of the present invention may contain a further auxiliary ingredient (C) in the form of element, oxide or carbide, if desired. The auxiliary ingredients which can be added are listed below.

Elements of Groups 5A and 6A in the Periodic Table may be added although their addition has no substantial effect. Since a substantial amount of the element added will adversely affect the properties of thermistor material, the amount of Group 5A or 6A element added should preferably be up to about 10% by weight, more preferably up to about 1% by weight.

The thermistor material of the present invention is preferably free of elements of Group 1A, for example, Na and Li. When voltage is applied to a thermistor element containing an alkali metal, alkali metal ions migrate and diffuse so that the resistance lowers with a lapse of time. The alkali metal tends to diffuse into glass during glass encapsulation, also inviting a deterioration. The content of Group 1A element should preferably be from 0 to 1% by weight, especially from 0 to 0.001% by weight calculated in elemental form.

The addition of Group 7A elements is also undesirable because these elements tend to change their valence, incurring a deterioration with a lapse of time. The content of Group 7A element should preferably be from 0 to 1% by weight, especially from 0 to 0.05% by weight calculated in elemental form.

The addition of Group 1B and 2B elements is also undesirable because these elements incur a deterioration with a lapse of time. The content of Group 1B or 2B element should preferably be from 0 to 1% by weight, especially from 0 to 0.05% by weight calculated in elemental form.

Elements of Group 3B other than B and Al, that is, Ga, In, and Tl may be contained, preferably in a minor amount of from 0 to about 1% by weight calculated in elemental form.

The content of Group 4B, 5B, 6B and 7B elements other than C, Si, O and N should preferably be limited to 0 to about 1% by weight calculated in elemental form because these elements adversely affect the properties of thermistor material.

The thermistor material of the present invention may contain a trace amount of a nitride, silicide or boride as the auxiliary ingredient. The foregoing auxiliary ingredients are preferably present in a total content of up to about 10% by weight of the thermistor material.

When the auxiliary ingredients are present as compounds in the sintered body, the compounds may more or less deviate from their stoichiometry. In general, the elemental metals have an average grain size of from about 1 to about 5 μm, and the compounds have an average grain size of from about 0.1 to about 5 μm.

The auxiliary ingredient is usually added in elemental, oxide or carbide form. If desired, the auxiliary ingredient may also be added in the form of a compound which can be converted to elemental, oxide or carbide form, for example, carbonates and organometallic compounds. Powders of the auxiliary ingredient generally have an average grain size of about 1 to about 5 μm and a purity of at least about 95% by weight. They may be added as a solution or dispersion.

The sintered body of the present invention may be prepared by the following procedure.

First, a predetermined amount of matrix powder such as aluminum oxide and a predetermined amount of silicon carbide and/or boron carbide powder are wet milled by adding them to a ball mill along with a medium such as ethanol and acetone.

The oxide powder such as aluminum oxide powder used herein preferably has an average grain size of about 0.1 to 5 μm and a purity of at least about 99.5% by weight. Instead of the oxide, a compound which can be converted into an oxide by sintering, for example, a carbonate and organometallic compounds may be used.

The silicon carbide (SiC) powder used herein preferably has an average grain size of about 0.5 to 5 μm and a purity of at least about 98% by weight. The boron carbide ($B_4C$) powder used herein preferably has an average grain size of about 0.5 to 5 μm and a purity of at least about 97% by weight.

The amount of solvent medium is about 100 to about 120% by weight based on the weight of powder. A dispersant may further be added if necessary.

The mixture is then compacted at room temperature. The pressure used in compacting ranges from about 500 to about 2,000 kg/cm$^2$.

The compact is sintered in an oxygen atmosphere or a non-oxidizing atmosphere by atmospheric pressure sintering, hot press (HP) sintering, and hot isotatic press (HIP) sintering techniques and then allowed to cool. The non-oxidizing atmosphere used in sintering may be an inert gas such as nitrogen, Ar and He, and hydrogen, CO and various hydrocarbons, and mixtures thereof as well as vacuum.

The atmospheric pressure sintering may be carried out under atmospheric pressure at a temperature of from about 1,600° to about 1,900° C., more preferably from about 1,750° to about 1,800° C. At temperatures of lower than about 1,600° C., the compact is not fully densified even by an extended sintering. Temperatures of higher than about 1,900° C. cause vigorous interaction to take place between the oxide such as $Al_2O_3$ and the carbide, SiC and/or $B_4C$. The sintering time generally ranges from about ½ to about 2 hours. Compacts are preferably sintered for about one hour at about 1,750° C.

In the case of HP sintering, the pressure applied to the press generally ranges from about 150 to about 250 kg/cm$^2$, and the temperature ranges from about 1,500° to about 1,800° C., preferably from about 1,650° to about 1,750° C. Temperatures of lower than about 1,500° C. are insufficient to form a dense sintered body. Temperatures of higher than about 1,800° C. cause vigorous interaction to take place between the oxide such as $Al_2O_3$ and the carbide, SiC and/or $B_4C$. The sintering time is generally from about 1 to about 3 hours.

In the case of HIP sintering, a compact of raw material powder is pre-sintered in an oxygen atmosphere or a non-oxidizing atmosphere, for example, up to 1,200° C. in vacuum and thereafter in an argon atmosphere, and then sintered in a HIP furnace. Pre-sintering is generally carried out at a temperature of from about 1,400° to about 1,650° for a period of from about 1 to about 3 hours. HIP sintering may be carried out at a temperature of from about 1,200° to about 1,500° C. under a pressure of from about 1,000 to about 1,500 kg/cm$^2$ for about 1 to about 5 hours in an oxygen atmosphere or an inert atmosphere, for example, an argon atmosphere. More particularly, oxygen or argon gas is pressurized to 300 to 400 kg/cm$^2$ at room temperature and thereafter further pressurized by heating.

The thermistor material thus prepared generally has a resistance of from about $10^2$ to about $10^7$Ω-cm at 500° C., and shows little change of resistance over a temperature range of from 400° to 800° C. It has a B value of from 1,000 to about 5,000 K at 50° to 480° C.

Figure 6:
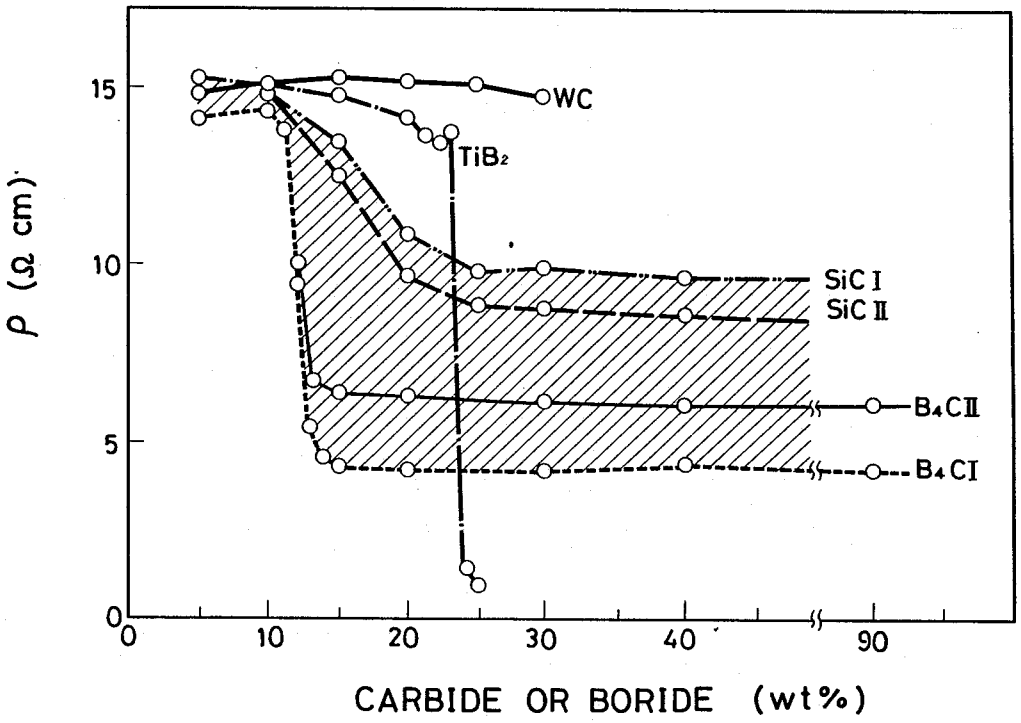
FIG. 6 is a diagram showing the resistivity of thermistor material as a function of carbide or non-oxide content.

The relationship of the resistivity (ρ) of thermistor material to its composition is examined. FIG. 6 shows the resistivity (ρ, in Ω-cm) of thermistor material as a function of its composition, that is, carbide content (in % by weight). Since the resistivity does not abruptly changes with the carbide content, it is easy to obtain a desired resistance by controlling the carbide content. It is to be noted that in the thermistor material shown in FIG. 6, aluminum oxide is used as an insulating material having an electric resistance R20 of at least $10^8\Omega$-cm.

When aluminum oxide is replaced by another oxide as previously described, the resulting material is improved in machinability, which is particularly advantageous in processing into thermistor chips.

In the practice of the present invention, the electric resistance of thermistor material can be controlled by adding at least one element selected from the Group 2A, 3A, and 4A elements and iron. The available electric resistance depends on the type of additive element.

| Element | Electric resistance (kΩ) |
|---|---|
| Group 2A | 100 to 400 |
| Group 3A | 130 to 140 |
| Group 4A | 60 to 300 |
| Iron | 20 to 80 |

The thermistor material thus obtained is processed into a thermistor chip before it is completed as a thermistor element. The thermistor chip generally has dimensions of about 0.5 to 1.0 mm by 0.5 to 1.0 mm by 0.5 to 1.0 mm thick.

The thermistor element of the present invention includes various types although a glass encapsulated thermistor element is preferred.

Figure 2:
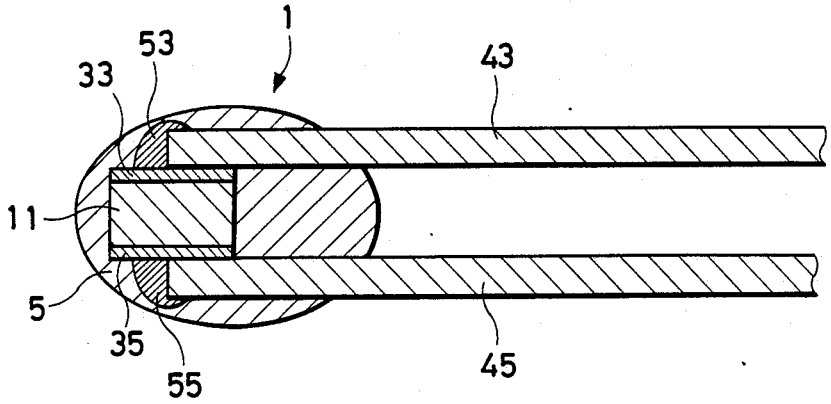
FIG. 2 is a cross-sectional view of a thermistor element according to one embodiment of the present invention.

Referring to FIG. 2, there is illustrated a glass encapsulated thermistor element 1 which includes a thermistor chip 11 having a pair of electrode layers 33 and 35 on its opposed sides. Leads 43 and 45 are connected to the electrode layers 33 and 35 via electroconductive pastes 53 and 55, respectively. The assembly is encapsulated with glass 5.

The electrode layers 33 and 35 are not particularly limited as long as they are electrodes consisting of or containing an electroconductive material commonly used in thermistor elements. The electroconductive material used herein includes any well-known conductive substances, for example, metals such as Au, Ag, Pt, Pd, W, Cu, Ni, Mo, Al, Fe, Ti, Mn, Nb, and Ta and alloys such as Pt-Au, Pd-Au, Pt-Pd-Au, Pd-Ag, Pt-Pd-Ag, Fe-Ni-Co, Fe-Ni, and Mo-Mn.

A first preferred example of the electrode layer is a metallized film. The metallized film may be formed of any well-known materials. Alloys containing nickel and iron, and molybdenum, tungsten or alloys thereof are preferred because they have a similar coefficient of thermal expansion and good adherence to the thermistor chip.

The alloys containing nickel and iron are preferably those alloys comprising 20 to 60% by weight of nickel and 80 to 40% by weight of iron. Another ingredient such as Co and Mn may be contained an an amount of up to 20% by weight. Because of coefficient of thermal expansion, Kovar alloy consisting of 29% by weight Ni, 17% by weight Co, and the remainder Fe and 42 Alloy consisting of 41–43% by weight Ni and the remainder Fe are preferred. Kovar alloy has a coefficient of thermal expansion approximate to that of hard glass and is thus used as hermetic sealant for hard glass and ceramics, and 42 Alloy is also known as hard and soft glass encapsulating material and used as hermetic sealant for transistor and diode leads, IC lead frames, and reed switch reeds.

Molybdenum Mo, tungsten W or alloys thereof are also suitable to form a metallized film. The alloys preferably contain more than about 20% by weight of Mo and/or W.

The electrode in the form of a metallized film formed by spraying is characterized by its surface roughness. A surface having a Rmax of at least 10 μm can be readily obtained although such a surface is not available with other conventional electrode forming techniques. Then the leads 43 and 45 can be firmly bonded to the electrode.

Metallizing has many advantages. Since metallizing does not accompany baking, there is no likelihood that the associated thermistor chip is damaged or deteriorated. An electrode layer can be formed to a sufficcient thickness by metallizing so that the electrode is free of aging deterioration. A further advantage is a firm bond between the metallized layer and leads. Since the metallized layer is free of glass, a firm bond is established between the layer and the thermistor chip without giving rise to foaming due to reaction with the carbide in the thermistor chip.

Metallizing may be carried out by various techniques using gas flame, electric arc and plasma as a heat source. Plasma spraying is most preferred because of bond and film thickness control.

The plasma spraying is a surface processing technique of melting powder material by utilizing the high heat energy a thermal plasma possesses, and directing the molten powder material to the surface of a substrate to form a film thereon. A coating of good adherence can be formed on a substrate at relatively low temperatures (100° to 300° C.) under atmospheric pressure at a high rate of deposition. A composite coating is also easily available.

Plasma spraying is generally carried out by maintaining an arc between water cooled anode and cathode by a high frequency starter or DC supply, and supplying a plasma gas to the arc to heat the gas to an extremely high temperature to generate a plasma jet. The gas from which the plasma jet is generated may be gases such as Ar, He, $H_2$, and $N_2$ and mixtures thereof. Powder material is then supplied to the plasma jet. The material is heated, melted, accelerated, and bombarded against the substrate surface. The sprayed material wetting the substrate is deprived of heat by the substrate and solidifies to form a coating.

In general, the flow rate of plasma gas is from about 1 to about 100 l/min., the substrate temperature is from about 100° to 300° C., the plasma jet temperature is from about 10,000° to about 30,000° C., and the powder material has a particle size of about 10 to about 60 μm.

The electrode layers 33, 35 thus formed generally have a thickness of about 5 to about 200 μm, preferably 20 to 150 μm, more preferably from about 50 to about 100 μm. A thickness of less than about 5 μm is inefficient to form whereas a thickness of more than about 200 μm has no additional benefit.

The electrode layers 33, 35 preferably have a surface roughness Rmax of about 10 to 40 μm.

Any desired undercoat layer may be formed below the electrode layers 33, 35 in the form of a sprayed layer. The undercoat layer may be a vacuum deposited film of various metals.

A second preferred example of the electrode layer is described below. Although a single layer of the following construction may be used, a two-layer structure as described below is preferred.

In the case of single layer construction, the electrode layers 33 and 35 may be prepared from a metal selected from tungsten, molybdenum, titanium, nickel, tantalum, niobium, iron, gold, silver, platinum, and palladium, or an alloy containing at least one such metal by a gas or liquid phase growing technique. This technique has an advantage that a change of electric resistance of thermistor material is minimized. When a metal is used alone, titanium, nickel, tungsten, molybdenum, tantalum, niobium and iron are preferred because a firm bond with the thermistor chip is available.

Alloys containing at least one of the foregoing metals are also useful. Preferred are alloys containing at least 50% by weight of at least one of the foregoing metals, such as Fe-Ni and Fe-Ni-Co alloys because of their coefficient of thermal expansion.

The gas and liquid phase growing techniques by which the electrode layers are formed may be any well-known techniques including electrolytic plating, electroless plating, vacuum deposition, sputtering, and ion plating. Preferred is vacuum deposition because a uniform thin film can be formed in high yields.

For vacuum depositing the electrode layer, any well-known methods may be employed.

The electrode layer generally has a thickness of from about 0.05 to about 5 μm, preferably from about 0.3 to about 2.0 μm. A layer of less than about 0.05 μm is too thin to be effective whereas a layer of more than about 5 μm thick is undesirable in productivity and cost.

An additional electrode layer may preferably be formed on the electrode layer. In this case, a first electrode layer is degreased and cleaned on its surface with a weak acid before a second electrode layer is formed thereon. Then adherence and ohmic contact between the layers are improved. Better results are obtained with respect to wetting to encapsulating glass and leads.

The additional or second electrode layer may be any desired one of electrode layers commonly used in thermistor elements. Because of coefficient of thermal expansion, reliability at high temperatures, and adherence to the underlying electrode layer, the following layers are preferred.

(1) Gas phase grown film of elemental metal or alloy

The metal material used is not particularly limited. However, gold, silver, platinum, and palladium alone and alloys containing at least one of these metals are preferred because better results are obtained with respect to reliability at high temperatures and productivity. Preferred alloys are those alloys containing at least 50% by weight of gold, silver, platinum, or palladium or a mixture thereof.

The second electrode layer having such a composition may be formed by a gas phase growing technique, particularly vacuum deposition. The second electrode layer may be vacuum deposited by any well-known techniques, for example, under an operating pressure of about $1\times10^{-3}$ to about $1\times10^{-4}$ Pa.

The second electrode layer generally has a thickness of from about 0.05 to about 5 μm, preferably from about 0.3 to about 2.0 μm. A layer of less than about 0.05 μm thick is ineffective whereas a layer of more than about 5 μm is undesirable in productivity and cost.

(2) Plated film

The metal material used is not particularly limited. However, gold, platinum, palladium, and nickel alone and alloys containing at least one of these metals, especially alloys containing gold, platinum or palladium are preferred because better results are obtained with respect to reliability at high temperatures and cost.

The plating method may be any well-known methods including electrolytic plating and electroless plating, although electrolytic plating is preferred with respect to purity and adherence. Electrolytic plating may be carried out under well-known conditions including electrolytic bath composition, electrode, tank, and operating temperature. The current density may be in the range of from about 0.5 to about 2.0 A/dm$^2$.

The metal is present along in the layer although one or two metals may be present in the layer in an amount of at least 50% by weight.

The second electrode layer generally has a thickness of from about 0.5 to about 5 μm, preferably from about 2 to about 3 μm. A layer of less than about 0.5 μm thick is ineffective whereas a layer of more than about 5 μm is undesirable in cost.

(3) Metal foil

The metal material used is not particularly limited. However, nickel, iron, tungsten, titanium, molybdenum and gold alone and alloys containing at least one of these metals are preferred because better results are obtained with respect to reliability at high temperatures.

Preferred metal foils are those containing nickel and iron, more preferably alloys containing 20 to 60% by weight of Ni and 80 to 40% by weight of Fe. Another metal ingredient such as cobalt and manganese may be present in an amount of less than about 20% by weight. Because of coefficient of thermal expansion, Kovar alloy consisting of 29% by weight Ni, 17% by weight Co, and the remainder Fe and 42 Alloy consisting of 41–43% by weight Ni and the remainder Fe are preferred.

Metal foils of tungsten, molybdenum, titanium, and gold are also preferred. These metals may be present alone or as an alloy containing at least 50% by weight of one or more metals of tungsten, molybdenum, titanium, and gold.

A second electrode layer may be formed from such a metal foil by any well-known technique. For example, a metal foil may be brazed using gold, platinum, palladium, and copper. Brazing may be carried out by any well-known methods under well-known conditions, for example, at a temperature of 1,000° to 1,200° C. in vacuum.

The second electrode layer generally has a thickness of from about 5 to about 200 μm, preferably from about 20 to about 50 μm. A layer of less than about 5 μm thick is inefficient to produce whereas a layer of more than about 50 μm is undesirable in configuration and cost.

(4) Sprayed film

The metal material used is not particularly limited. However, alloys containing nickel and iron, and tungsten, molybdenum and alloys thereof are preferred because better results are obtained with respect to reliability at high temperatures and productivity.

Preferred examples of the alloys containing nickel and iron are the same as described in (3).

Molybdenum, tungsten, and alloys containing molybdenum and/or tungsten are also preferred. Alloys containing at least 50% by weight of molybdenum and/or tungsten are more preferred.

Spraying may be carried out by various techniques using gas flame, electric arc and plasma as a heat source as previously described in metallizing. Plasma spraying is most preferred because of bond and film thickness control.

A third preferred example of the electrode layer is formed by a thick film technique. More particularly, the electrode layers 33 and 35 may be formed by a thick film technique comprising baking of electroconductive paste. Preferred conductive paste is substantially free of glass. One commercially available conductive paste is a fritless conductive paste which is usually a mixture of conductive material, binder, solvent and preferably oxide.

The conductive materials may be any well-known conductive materials, for example, metals such as Au, Ag, Pt, Pd, W, Cu, Ni, Mo, Al, Fe, Ti, and Mn and alloys such as Pt-Au, Pd-Au, Pt-Pd-Au, Pd-Ag, Pt-Pd-Ag, Fe-Ni-Co, Fe-Ni, and Mo-Mn.

The conductive materials and oxides are generally used in grain form having a grain size of from about 0.1 to about 5 μm.

Examples of the oxide which is preferably added to the paste include well-known oxides such as $TiO_2$, CuO, CdO, MnO, CaO, ZnO, $Bi_2O_3$, $V_2O_5$, and NiO. The amount of oxide added is preferably less than about 20% by weight, more preferably from about 0.05 to about 10% by weight based on the weight of solids.

The binder may be any well-known binders such as ethyl cellulose.

The solvent may be any well-known solvents such as butyl cellulose, butyl carbitol acetate, and terpineol. It is added so as to form a paste having a viscosity of from about 120 to about 320 Pa.s.

The conductive paste of the above-mentioned composition is applied to a thermistor chip by a screen printing technique and baked into an electrode layer. The baking temperature preferably ranges from about 500° to about 1,400° C. and the baking time ranges from about ½ to about 2 hours. The baking atmosphere may be either an oxygen containing atmosphere or an inert gas atmosphere.

Since the electrode layer thus formed is substantially free of glass, it does not give rise to foaming due to reaction with the carbide in the thermistor chip. The adherence and bond between the electrode layer and the thermistor chip are improved.

Pastes based on various alkoxides, organometallic compounds and organometals such as organic metal complexes are also useful. The term substantially free of glass means that glass components, especially $SiO_2$, $B_2O_3$, PbO and $P_2O_5$ are present in an amount of less than about 1% by weight, especially less than about 0.3% by weight of the solids.

The electrode layers 33 and 35 thus formed generally have a thickness of from about 5 to about 200 μm, preferably from about 10 to 50 μm, more preferably from about 15 to 30 μm. A layer of less than about 5 μm thick is inefficient to produce whereas a layer of more than 200 μm thick has no additional benefit.

The leads 43 and 45 of the thermistor element 1 may be of any desired well-known materials. Because of coefficient of thermal expansion and cost, Kovar alloy consisting of 29% by weight Ni, 17% by weight Co, and the remainder Fe and 42 Alloy consisting of 41–43% by weight Ni and the remainder Fe are preferred. Kovar alloy has a coefficient of thermal expansion approximate to that of hard glass and is thus used as hermetic sealant for hard glass and ceramics, and 42 Alloy is also known as hard and soft glass encapsulating material and used as hermetic sealant for transistor and diode leads, IC lead frames, and reed switch reeds.

The leads are preferably coated on the surface with a heat resistant film such as a Ni plating because such a coating is effective in preventing oxidation and increasing heat resistance during glass encapsulation.

The leads may be connected to the electrode layers by any well-known methods, for example, by applying an electroconductive paste such as gold paste to form an electric contact as shown at 53 and 55 in FIG. 2, or by parallel gap welding or supersonic bonding.

The use of conductive paste is advantageous in that manufacture is easy, and little damage is incurred in the element. The paste may contain a particulate conductive material, a solvent and optionally a binder. Glass fritfree pastes are preferred for the same reason as described above. The same conductive paste as used to form the electrode layer may also be used for connection purpose.

Baking may be carried out at the same time as baking of an electrode layer if the electrode layer is formed by a thick film forming technique.

Spot welding is also a useful connecting method. Spot welding may be carried out by well-known methods, for example, by applying electric current across leads to heat the leads to a welding temperature for a sufficient time to complete a weld, or placing the entire thermistor element in an oven to heat it to a welding temperature. Detail of spot welding is described in Japanese Patent Publication No. 42-19061.

Supersonic bonding may be carried out by any well-known methods.

It is also possible to complete the thermistor element without leads.

The glass used for encapsulating the thermistor element according to the present invention is preferably a glass having a glass transition temperature of at least 600° C., more preferably from about 600° to about 700° C., and a working temperature of at most about 1,000° C., more preferably from about 800° to about 1,000° C.

The composition of glass is not particularly limited as long as the glass transition temperature and working temperature fall within the above-defined ranges. Preferred is borosilicate glass containing alkaline earth metal.

The borosilicate glass containing alkaline earth metal preferably has a composition containing about 40 to 85% by weight, more preferably 40 to 70% by weight of $SiO_2$ and about 5 to 40% by weight, more preferably 10 to 40% by weight, most preferably 21 to 40% by weight of $B_2O_3$. The content of alkaline earth metal preferably ranges from about 5 to about 30% by weight. The glass may further contain $Al_2O_3$, preferably in an amount of up to 5% by weight. It is preferred that the glass contain up to about 1% by weight of an alkali component such as Na and K because the presence of alkali incurrs a lowering of insulation resistance at high temperatures.

One example of fabricating a thermistor element according to the present invention is described below.

First, a wafer having a diameter of about 3 inches and a thickness of about 0.5 mm is prepared from a sintered body having the composition defined in the present invention. An electrode layer is formed on either surface of the wafer. The wafer is then cut into square shaped chips of dimensions 0.75×0.75 mm by means of a dicing saw.

Leads of Kovar or 42 Alloy having a diameter of 0.2 to 0.5 mm and a length of 20 to 100 mm are connected to the electrode layers on the chip by any of the above-mentioned bonding methods.

The chip is then inserted into a glass tube of preferably borosilicate glass having a diameter of 1.5 to 2.5 mm and a length of 5 mm. The assembly is heated at a temperature of 750° to 900° C. in an inert atmosphere such as an argon gas atmosphere to complete encapsulation. The resulting element is aged at a temperature of about 500° to about 750° C. for about 10 to about 100 hours if desired.

The themistor material of the present invention may also be applied as a chip to an integrated thermistor element wherein heat and pressure are applied to conductive material placed on thermistor material with or without an intervening layer to thereby integrate the conductive material and thermistor material.

Figure 3:
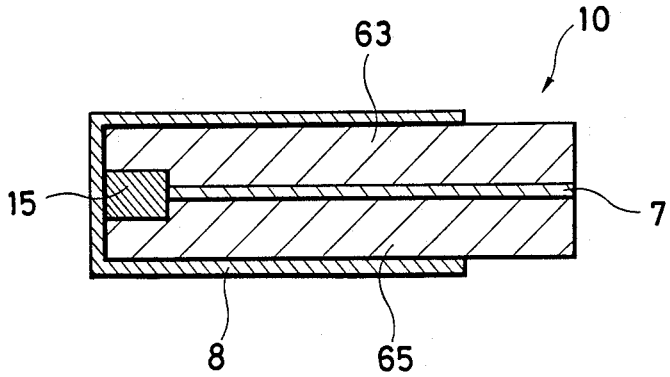
FIG. 3 is a cross-sectional view of a thermistor element according to another embodiment of the present invention.

One example of the integrated thermistor element is shown in FIG. 3. The thermistor element designated at 10 has a prism configuration. It includes a thermistor chip 15 at one end of an insulator 7. Conductors 63 and 65 cover the opposed surfaces of the thermistor chip 15 and the insulator 7. The conductors are covered with a protective coating 8.

Also useful are a structure similar to that shown in FIG. 3 except that the insulator is omitted, that is, a structure having only a pair of conductors 63,65 sandwiching the opposed surfaces of the thermistor chip 15, and a structure wherein an interlayer of high melting metal intervenes between the thermistor chip 15 and the conductors 63,65. A multi-element of laminate structure is also useful.

The integrated thermistor element is described in Japanese Patent Application Nos. 61-282256, 61-282257, 61-286533, 61-286534, and 62-247265.

The thermistor material of the present invention is stable at high temperatures, particularly at temperatures of from about 400° C. to about 800° C. Since the B value can be lowered, the thermistor material has a low temperature coefficent and has a wide available temperature range. Since the change of resistivity of thermistor material with the carbide content is moderate, the resistance can be controlled by a proper choice of the composition. A wide range of composition is available for the intended resistance value, leading to advantages of mass productivity and quality.

The thermistor material of the present invention may be used to form a glass encapsulated thermistor element while minimizing the risk of foaming. It may also be used to form an integrated thermistor element by heating the thermistor material and another material under pressure to bond them into an integrated assembly. The resulting element has a high dimensional accuracy and exhibits little variation in dimension and property which is otherwise considerable when raw materials are integrated by sintering.

EXAMPLES

Examples of the present invention are presented below by way of illustration and not by way of limitation. In the examples and tables, $SiC/Al_2O_3$ is the volume ratio of silicon carbide to aluminum oxide and Da/Dt is the actual density (Da) of a material divided by its theoretical density (Dt) expressed in %.

EXAMPLE 1

Preparation and measurement of sample

Aluminum oxide $Al_2O_3$ having an average grain size of 1.2 μm and a purity of at least 99.9% by weight, silicon carbide SiC having an average grain size of 1.0 μm and a purity of at least 99.5% by weight, and boron carbide $B_4C$ having an average grain size of 1.2 μm and a purity of at least 98% by weight were weighed in amounts as reported in Table 1 and wet milled for 20 hours in a ball mill along with acetone.

The slurry was dried and granulated. A graphite mold having a cavity with a diameter of 77 mm was filled with the granules. The compact was hot press sintered in an argon atmosphere or vacuum of $10^{-2}$ Torr at a temperature of 1,300° to 1,700° C. and a press pressure of 200 to 300 kg/cm$^2$.

The mold was cooled and the sintered body was taken out of the mold. The sintered body was analyzed by X-ray diffraction to find that the body consisted of $Al_2O_3$ and $B_4C$ and/or SiC. In some samples, the presence of the oxide of B and/or Si was observed at the grain boundary.

The sintered body was cut into chips of $0.75\times0.75\times0.5$ mm thick by means of a #200 diamond abrasive wheel.

Electrodes were formed on the chip by a suitable metallizing method and measured for resistivity ρ(Ω-cm) at 50° C. and 480° C. and thermistor constant B.

Next a thermistor element as shown in FIG. 3 was fabricated using a composite sintered body (65 mm wide, 1.6 mm long, 0.5 mm thick) prepared as above as the thermistor material, a composite sintered body of $TiC-Al_2O_3$ (65 mm wide, 130 mm long, 0.3 mm thick) as the conductive material, and a sintered body of $Al_2O_3$ (65 mm wide, 64.2 mm long, 0.5 mm thick) as the insulating material. The components were placed one on top of the other, and heated under pressure by a hot press technique to bond the components. Heating was carried out for 30 minutes at a temperature of 1,300° C. in an argon atmosphere under a pressure of 150 kg/cm$^2$.

The resulting composite sintered structure (65 mm wide, 130 mm long, 1.1 mm thick) was taken out of the mold and allowed to cool to room temperature. The upper and lower surface of the structure were lapped to about 20 μm. The structue was then cut by means of a diamond blade of a peripheral slicing machine into thermistor elements (0.75 mm wide, 65 mm long, 1.1 mm thick) having a thermistor chip of 0.75 by 0.75 by 0.5 mm (thick) and conductors of 0.3 mm thick. From one composite sintered structure, 100 thermistor elements could be obtained.

The elements were aged. They were tested to determine a change of resistance after being kept at 500° C. for 3,000 hours. The perfect resistance change is represented by $\Delta R/RO\times100\%$ wherein RO is an initial resistance and ΔR is a change of resistance.

The results are shown in Table 1. It is to be noted that the chips and elements are reported with the same sample number for brevity of description.

Table 1 also reports the volume ratio of $SiC/Al_2O_3$ and the ratio (Da/Dt in %) of the actual density (Da) of a sintered body to its theoretical density (Dt). The volume ratio was obtained by polishing the surface of a sintered body to a mirror finish, observing the polished surface under a microscope, determining the surface areas of oxide and carbide(s), and calculating the ratio in surface area of $SiC/Al_2O_3$.

Figure 4:
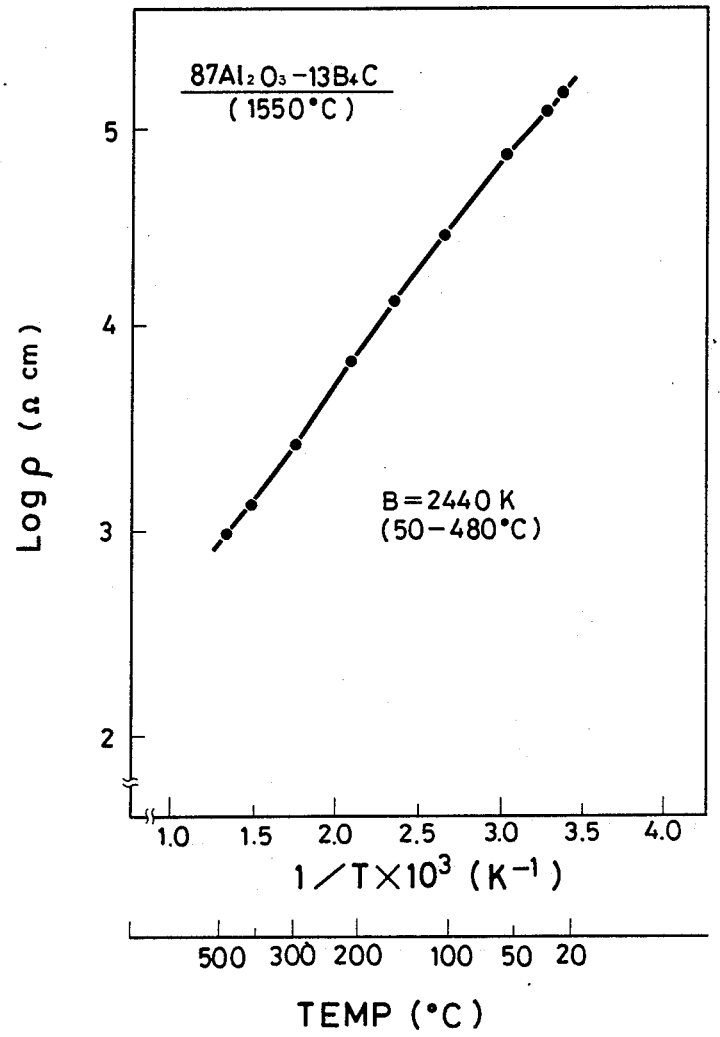
FIGS. 4 and 5 are diagrams showing the resistivity of thermistor material as a function of temperature.
Figure 5:
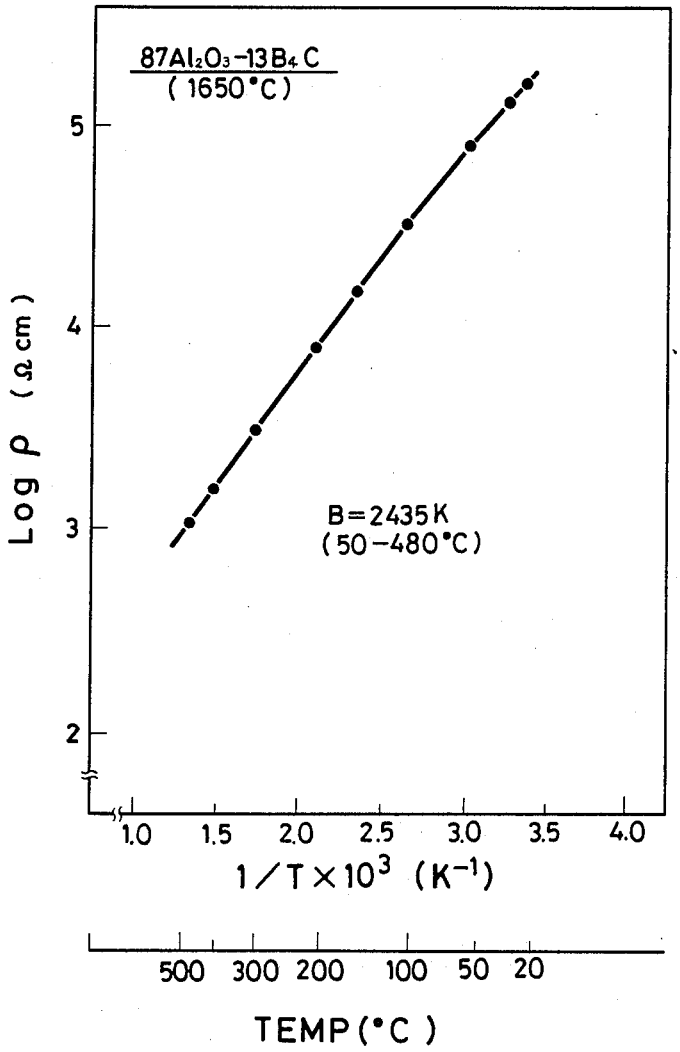

FIGS. 4 and 5 show the resistivity ($\rho$) of sample Nos. 102 and 104 as a function of temperature (T).

Figure 7:
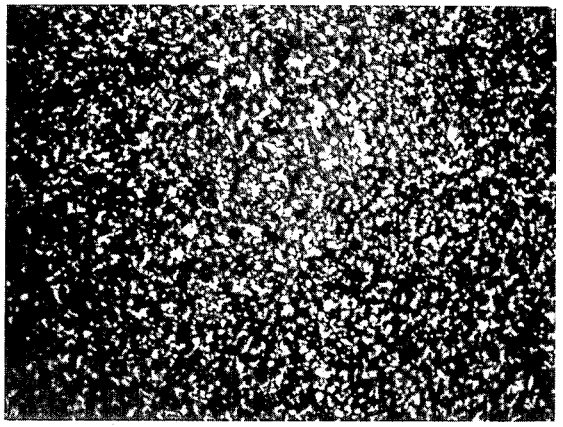
FIGS. 7 and 8 are photomicrographs of thermistor materials according to the present invention, illustrating their grain structure.
Figure 8:
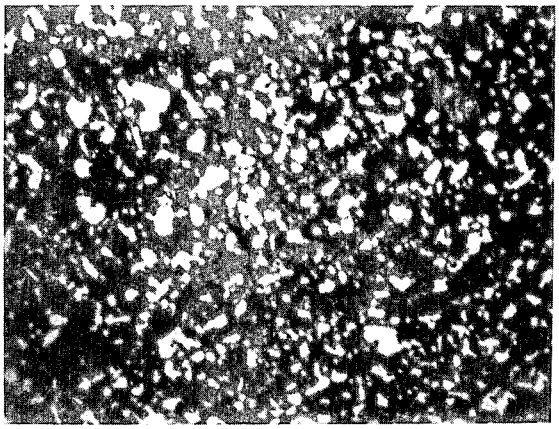

Metallurgical photomicrographs of sample No. 111 are shown in FIG. 7 (multiplication ×400) and FIG. 8 (multiplication ×1,000).

Prepration and measurement of comparative sample

Samples having compositions outside the scope of the present invention were prepared by the same procedure as in the prevent invention and measured by the same procedure. The results are also shown in Table 1.

A further thermistor element was fabricated using raw material having the same composition as sample No. 101 as the thermistor material, and raw materials having the same compositions as the conductive material and insulating material as used in fabricating the thermistor element according to the prevent invention. They were integrated by the method described in Japanese Patent Application Kokai No. 60-37101, and then hot press (HP) sintered.

The thermistor elements obtained by integrating raw materials followed by HP sintering changed their dimensions or shape before and after sintering of integrated structure. The variation in resistance was as large as 5% or more for 100 elements.

The elements of the present invention showed a variation in resistance of less than 1%.

resistance can be readily obtained by changing the composition. In contrast, the $Al_2O_3$-WC system does not lower its resistivity because WC is oxidized. The $Al_2O_3$-$TiB_2$ system abruptly changes its resistivity with a change of the boride content of 1% by weight.

A similar phenomenon to the $Al_2O_3$-WC system was observed when MoC, WB, MoB, $ZrB_2$ or CrB was added to aluminum oxide. A similar phenomenon to the $Al_2O_3$-$TiB_2$ system was observed when $ZrSi_2$ was added to aluminum oxide.

When the ratio of $B_4C$ to SiC was changed in the $Al_2O_3$-$B_4C$-SiC system, resistivity changes were observed which fall in the cross-hatched region between $Al_2O_3$-$B_4C$ system I and $Al_2O_3$-SiC system I.

As seen from FIG. 6, the region where the resistance moderately changes with the carbide content corresponds to the region enclosed by DHIF, more preferably JKLM in FIG. 1. A desired resistance is obtained in this region.

Since a saturated value of resistance is within the thermistor performance region for $Al_2O_3$-SiC system I and $Al_2O_3$-$B_4C$ system II using high purity $B_4C$ and SiC, these systems can be utilized even with a composition below line GC.

EXAMPLE 3

Various samples were prepared by repeating the procedure of sample Nos. 101 to 111 in Example 1 except that $Al_2O_3$ (Dt 3.98) in the thermistor material was replaced by the same volume of glass species, $3Al_2O_3 0.2SiO_2$ (Dt 3.24), $2MgO.SiO_2$ (Dt 3.71), MgO (Dt 3.65), BaO $Al_2O_3 0.2SiO_2$ (Dt 3.30), $2CaO.SiO_2$ (Dt 3.28), 2CaO $Al_2O_3.Sio_2$ (Dt 3.04), $2MgO.2Al_2O_3 0.5SiO_2$ (Dt 2.51), SrO $Al_2O_3 0.2SiO_2$ (3.12), BaO $Al_2O_3$ (Dt 3.99), $CaO 0.2Al_2O_3$ (Dt. 2.90), and MgO $Al_2O_3$ (Dt 3.59). These samples had a ratio of actual density (Da) to theoretical density (Dt) in the range of from 90 to 100%. Their volume ratios of SiC/matrix were similar to those of sample Nos. 101 to 111.

The samples were examined for machinability. Machinability is tested by carrying out a cutting test as follows to determine a rate of cutting. In the cutting test, the samples were cut by a peripheral slicing machine under the following conditions.

Diamond blade: #400, 0.2 mm thick

Abrasive wheel revolution: 30,000 rpm

Cutting liquid: aqueous cutting liquid.

The cutting rate was selected such that chipping was up to 5 λm and the diamond blade did not fracture.

The cutting rate ranged from 0.8 to 2 mm/sec. for the samples of this Example whereas it ranged from 3 to 5

TABLE 1

| Sample No. | Composition (wt. %) $Al_2O_3$ | $B_4C$ | SiC | Sintering temp. (°C.) | $SiC/Al_2O_3$ | Da/Dt | $\rho$(Ω-cm) @ 50° C. | @ 480° C. | B(K) | ΔR/R0 |
|---|---|---|---|---|---|---|---|---|---|---|
| 101 | 86 | 14 | 0 | 1450 | 0 | >95% | $1.7 \times 10^4$ | $4.4 \times 10^2$ | 2050 | <1% |
| 102 | 87 | 13 | 0 | 1550 | 0 | >95% | $7.2 \times 10^4$ | $9.6 \times 10^2$ | 2440 | <1% |
| 103 | 85 | 15 | 0 | 1550 | 0 | >95% | $1.3 \times 10^4$ | $3.1 \times 10^2$ | 2050 | <1% |
| 104 | 87 | 13 | 0 | 1650 | 0 | >95% | $8.0 \times 10^4$ | $1.1 \times 10^3$ | 2430 | <1% |
| 105 | 86 | 14 | 0 | 1650 | 0 | >95% | $1.2 \times 10^4$ | $3.2 \times 10^2$ | 2020 | <1% |
| 108 | 87 | 12 | 1 | 1550 | 0.014 | >95% | $5.5 \times 10^6$ | $1.7 \times 10^4$ | 3250 | <1% |
| 109 | 87 | 11 | 2 | 1550 | 0.029 | >95% | $1.2 \times 10^7$ | $1.2 \times 10^4$ | 3500 | <1% |
| 110 | 86 | 11 | 3 | 1550 | 0.043 | >95% | $8.8 \times 10^6$ | $1.9 \times 10^4$ | 3470 | <1% |
| 111 | 85 | 12 | 3 | 1650 | 0.044 | >95% | $1.1 \times 10^4$ | $8.2 \times 10^2$ | 1450 | <1% |
| 121* | 100 | 0 | 0 | 1550 | 0 | >95% | $>10^{14}$ | $1.6 \times 10^{10}$ | outside thermistor region | |
| 122* | 40 | 0 | 60 | unsinterable | — | — | — | — | — | — |
| 123* | 20 | 0 | 80 | unsinterable | — | — | — | — | — | — |
| 124* | 0 | 100 | 0 | unsinterable | — | — | — | — | — | — |

*outside the scope of the invention

EXAMPLE 2

Sintered bodies of $Al_2O_3$-SiC system I, $Al_2O_3$-$B_4C$ system I, and $Al_2O_3$-$B_4C$-SiC system were prepared using the same $Al_2O_3$, SiC and $B_4C$ as used in Example 1. The amount of SiC, $B_4C$ and $B_4C$+SiC (to be simply referred to as carbide content) in % by weight based on the total weight was changed to determine the relation of resistivity ($\rho$,Ω-cm) to carbide content.

Sintered bodies of $Al_2O_3$-SiC system II and $Al_2O_3$-$B_4C$ system II were pepared using a SiC powder with a purity of 98.5% by weight and a $B_4C$ powder with a purity of 99.5% by weight. The carbide content was changed to determine the relation of resistivity ($\rho$,Ω-cm) to carbide content (% by weight).

Similarly $Al_2O_3$-WC and $Al_2O_3$-$TiB_2$ systems were examined for the relation of resistivity to carbide or boride content.

The results are shown in FIG. 6.

It is seen from FIG. 6 that the resistance change is not steep for the $Al_2O_3$-SiC systems I and II, $Al_2O_3$-$B_4C$ systems I and II, and $Al_2O_3$-$B_4C$-SiC system according to the present invention. This indicates that any desired mm/sec. for the samples of Example 1. The results reveal that the samples of this Eample are improved in machinability over the samples of Example 1.

Equivalent results were obtained when the samples of this Example were examined for the same properties as in Example 1.

EXAMPLE 4

A composite sintered body of a composition shown in Table 2 having a diameter of 3 inches and a thickness of 0.5 mm was prepared by hot press sintering a corresponding compact under the conditions shown in Table 2.

The coefficient of thermal expansion $\mu$ over the temperature range of from 30° to 500° C., the volume ratio of $SiC/Al_2O_3$, and the ratio (Da/Dt) of actual density (Da) to theoretical density (Dt) of the sintered body are also reported in Table 2. Calculation is the same as described in Example 1.

These samples were examined for the following properties.

(1) Resistance change

The resistance of a sample was measured before and after it was kept at 500° C. for 5,000 hours. The percent resistance change is represented by $$\Delta R/RO \times 100\%$$

wherein RO is an initial resistance and $\Delta R$ is a change of resistance.

(2) Ohmic contact

The current and voltage applied across a sample was measured before and after it was kept at 500° C. for 5,000 hours, to examine any deterioration of ohmic contact. The sample is rated by 0 or X.

O: unchanged

X: deteriorated.

The results are shown in Table 2.

TABLE 2

| Sample No. | Thermistor chip: Composition (wt. %) | Sintering temp. (°C.) | Pressure (kg/cm²) | $\mu$ | $SiC/Al_2O_3$ | Da/Dt | Electrode layer: Comp. | Formation |
|---|---|---|---|---|---|---|---|---|
| 401 | $Al_2O_3$ 86/$B_4C$ 14 | 1650 | 200 | 62 | 0 | >95% | 42Alloy | Plasma spray |
| 402 | $Al_2O_3$ 86/$B_4C$ 14 | 1650 | 200 | 62 | 0 | >95% | Kovar | Plasma spray |
| 403 | $Al_2O_3$ 86/$B_4C$ 14 | 1650 | 200 | 62 | 0 | >95% | W | Plasma spray |
| 404 | $Al_2O_3$ 86/$B_4C$ 14 | 1650 | 200 | 62 | 0 | >95% | Mo | Plasma spray |
| 405 | $Al_2O_3$ 78/$B_4C$ 11/ SiC 11 | 1700 11 | 200 | 68 | 0.175 | >95% | 42Alloy | Plasma spray |
| 406* | Mn—Ni—Co composite oxide | 1300 | 150 | 90 | — | >95% | Au | Thick film printing followed by 850° C. baking |

| Sample No. | Thick ($\mu$m) | Lead | ΔR/R0 | Ohmic contact |
|---|---|---|---|---|
| 401 | 60 | Kovar | +1.5% | O |
| 402 | 60 | Kovar | +1.7% | O |
| 403 | 60 | Kovar | +1.2% | O |
| 404 | 60 | Kovar | +1.1% | O |
| 406* | 20 | Kovar | >+30% in 1000 hr. | X |

*comparison $\mu$: coefficient of thermal expansion over temperature range of 30 to 500° C., expressed in unit of $\times 10^{-7}$/deg.

An electrode layer was formed on either surface of the composite sintered body to a thickness of 60 $\mu$m by plasma spraying. The composition of the electrode layer is also reported in Table 2. Plasma spraying was carried out under conditions: plasma gas argon, gas flow rate 5 to 20 liter/min., substrate temperature 200° to 300° C. and spraying particle size 5 to 20 λm. The sprayed layers had a surface roughness Rmax of about 30 $\mu$m.

The wafer was then cut by means of a diamond blade of a peripheral slicing machine into square thermistor chips of 0.75 mm by 0.75 mm.

To the thermistor chip leads having a diameter of 0.3 mm and a length of 65 mm were bonded with glass fritless gold paste. The material of the leads is shown in Table 2.

The lead-bonded chip was placed in a borosilicate glass tube having a diameter of 2.5 mm and a length of 4 mm and encapsulated therewith by heating at 85° C. in an argon gas atmosphere. There was obtained a thermistor element as shown in FIG. 2. The element was aged. In this way, a series of thermistor elements were fabricated.

For comparison purposes, thermistor elements outside the scope of the present invention were also prepared. The parameters of the thermistor chip and electrode layer used are reported in Table 2.

Figure 9:
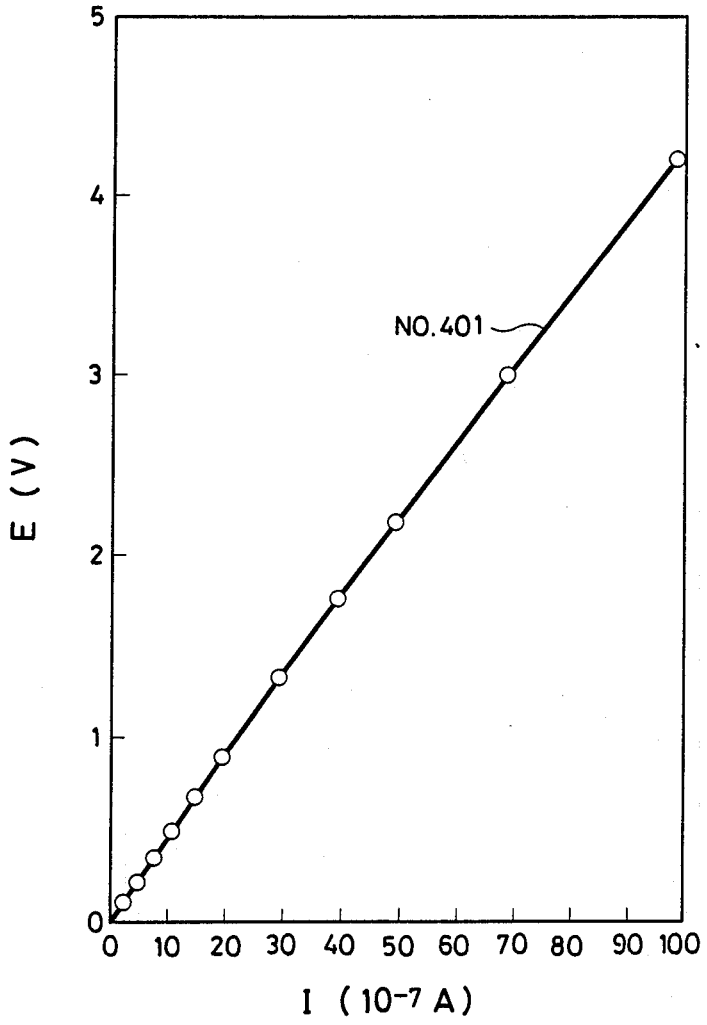
FIGS. 9 and 10 are diagrams of voltage and current applied to thermistor materials according to the present invention.

Sample No. 401 was examined for ohmic contact after it was kept at 500° C. for 5,000 hours. The results are shown in FIG. 9 where voltage E (in volt) is plotted as a function of current I (in $\times 10^{-7}$ ampere).

The effectiveness of the present invenion is evident from these data.

EXAMPLE 5

A composite sintered body of a composition shown in Table 3 having a diameter of 3 inches and a thickness of 0.5 mm was prepared by hot press sintering a corresponding compact under the conditions shown in Table 3.

The coefficient of thermal expansion $\mu$ over the temperature range of from 30° to 500° C., the volume ratio of $SiC/Al_2O_3$, and the ratio (Da/Dt) of actual densiy (Da) to theoretical density (Dt) of the sintered body are also reported in Table 3. Calculation is the same as described in Example 1.

An electrode layer was formed on either surface of the composite sintered body by vacuum deposition. The composition and thickness of the electrode layer are reported in Table 3. Vacuum deposition was carried out under an operating pressure of $3 \times 10^{-4}$ Pa.

A second electrode layer was formed on some samples. The composition and thickness of the second electrode layer are reported in Table 3 as well as the method of forming. The method included vacuum deposition (VD), plating, foil brazing, and plasma spraying. Plasma spraying was carried out under conditions: plasma gas argon, gas flow rate 5 to 20 liter/min., substrate temperature 200° to 300° C. and spraying particle size 5 to 20 μm. The sprayed layers had a surface roughness Rmax of about 30 μm. A metal foil was brazed wih palladium at 1,100° C. Plating was carried out at a current density of 1 A/dm$^2$.

The wafer was then cut by means of a diamond blade or a peripheral slicing machine into square thermistor chips of 0.75 mm by 0.75 mm.

To the thermistor chip leads having a diameter of 0.3 mm and a length of 65 mm were bonded with lass fritless gold paste. The material of the leads is shown in Table 3.

The lead-bonded chip was placed in a borosilicate glass tube having a diameter of 2.5 mm and a length of 4 mm and encapsulated therewith by heating at b 85° C. in an argon gas atmosphere. There was obtained a thermistor element as shown in FIG. 2. The element was aged. In this way, a series of thermistor elements were fabricated.

For comparison purposes, thermistor elements outside the scope of the present invention were alsp prepared. The parameters of the thermistor chip and electrode layer used are reported in Table 3.

These samples were examined for resistance change (ΔR/RO×100%) and ohmic contact by the same procedures as in Example 4.

The results are shown in Table 3.

TABLE 3

| Sample No. | Thermistor chip: Composition (wt. %) | Sintering temp. (°C.) | Pressure (kg/cm$^2$) | μ | SiC/$Al_2O_3$ | Da/Dt | 1st electrode: Type | Thick |
|---|---|---|---|---|---|---|---|---|
| 501 | $Al_2O_3$ 86/$B_4C$ 14 | 1650 | 200 | 62 | 0 | >95% | Ni | 0.5 |
| 502 | $Al_2O_3$ 78/$B_4C$ 11/ SiC 11 | 1700 11 | 200 | 58 | 0.175 | >95% | NI | 0.5 |
| 503 | $Al_2O_3$ 86/$B_4C$ 14 | 1650 | 200 | 62 | 0 | >95% | W | 0.5 |
| 502 | $Al_2O_3$ 86/$B_4C$ 14 | 1650 | 200 | 62 | 0 | >95% | Mo | 0.5 |
| 505 | $Al_2O_3$ 86/$B_4C$ 14 | 1650 | 200 | 62 | 0 | >95% | Ti | 0.5 |
| 506 | $Al_2O_3$ 86/$B_4C$ 14 | 1650 | 200 | 62 | 0 | >95% | Ta | 0.5 |
| 507 | $Al_2O_3$ 86/$B_4C$ 14 | 1650 | 200 | 62 | 0 | >95% | Nb | 0.5 |
| 508 | $Al_2O_3$ 86/$B_4C$ 14 | 1650 | 200 | 62 | 0 | >95% | Fe | 0.5 |
| 509 | $Al_2O_3$ 86/$B_4C$ 14 | 1650 | 200 | 62 | 0 | >95% | Au | 0.5 |
| 510 | $Al_2O_3$ 86/$B_4C$ 14 | 1650 | 200 | 62 | 0 | >95% | Ag | 0.5 |
| 511 | $Al_2O_3$ 86/$B_4C$ 14 | 1650 | 200 | 62 | 0 | >95% | Pt | 0.5 |
| 512 | $Al_2O_3$ 86/$B_4C$ 14 | 1650 | 200 | 62 | 0 | >95% | Pd | 0.5 |
| 513 | $Al_2O_3$ 86/$B_4C$ 14 | 1650 | 200 | 62 | 0 | >95% | Ni | 0.5 |
| 514 | $Al_2O_3$ 86/$B_4C$ 14 | 1650 | 200 | 62 | 0 | >95% | Ni | 0.5 |
| 515 | $Al_2O_3$ 86/$B_4C$ 14 | 1650 | 200 | 62 | 0 | >95% | Ni | 0.5 |
| 516 | $Al_2O_3$ 86/$B_4C$ 14 | 1650 | 200 | 62 | 0 | >95% | Ni | 0.5 |
| 517 | $Al_2O_3$ 86/$B_4C$ 14 | 1650 | 200 | 62 | 0 | >95% | Ni | 0.5 |
| 518 | $Al_2O_3$ 86/$B_4C$ 14 | 1650 | 200 | 62 | 0 | >95% | Ni | 0.5 |
| 519 | $Al_2O_3$ 86/$B_4C$ 14 | 1650 | 200 | 62 | 0 | >95% | Ni | 0.5 |
| 520 | $Al_2O_3$ 86/$B_4C$ 14 | 1650 | 200 | 62 | 0 | >95% | Ni | 0.5 |
| 521 | $Al_2O_3$ 86/$B_4C$ 14 | 1650 | 200 | 62 | 0 | >95% | W | 0.5 |
| 522* | composite Mn—Ni—Cr | 1300 | 150 | 90 | — | >95% | Ni | 0.5 |
| 523* | composite Mn—Ni—Cr | 1300 | 150 | 90 | — | >95% | Ni | 0.5 |
| 524* | $Al_2O_3$ 30/SiC 70 | 1900 | 200 | 42 | 2.893 | >95% | Ni | 0.5 |

Figure 10:
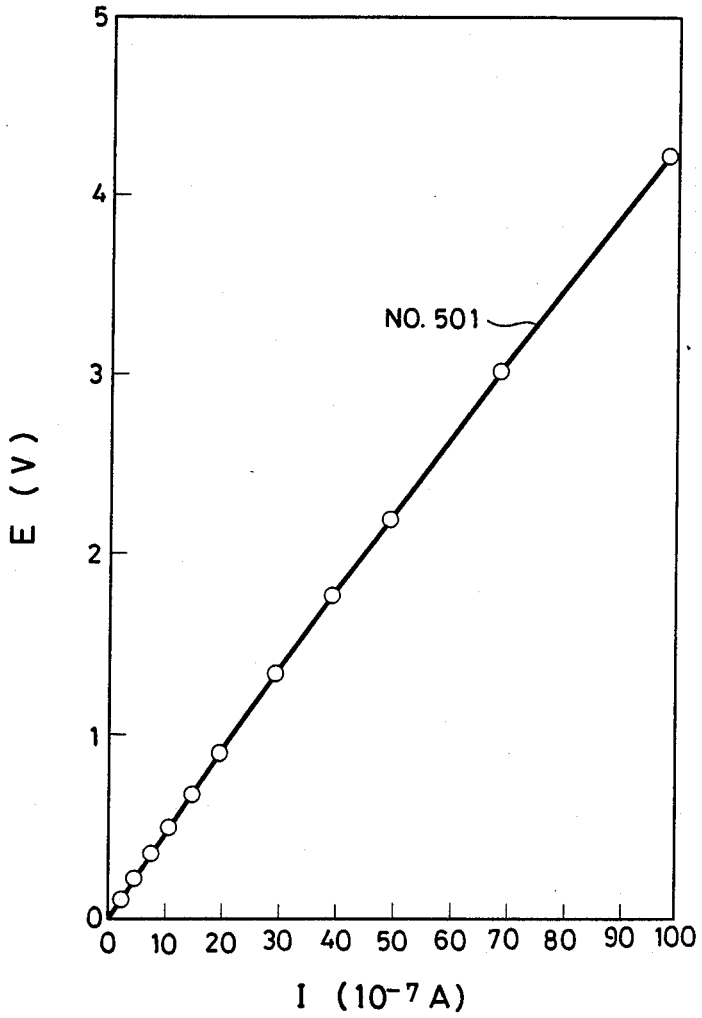

| Sample No. | 2nd electrode: Type | Formation | Thick | Lead | ΔR/R0 | Ohmic contact |
|---|---|---|---|---|---|---|
| 501 | Pt | VD | 0.5 | 42Alloy | +1.5% | O |
| 502 | Pt | VD | 0.5 | 42Alloy | +1.7% | O |
| 502 | Pt | VD | 0.5 | Kovar | +1.4% | O |
| 502 | Pt | VD | 0.5 | Kovar | +1.6% | O |
| 505 | Pt | VD | 0.5 | Kovar | +0.8% | O |
| 506 | Pt | VD | 0.5 | Kovar | +1.8% | O |
| 507 | Pt | VD | 0.5 | Kovar | +1.2% | O |
| 508 | Pt | VD | 0.5 | Kovar | +1.8% | O |
| 509 | Pt | VD | 0.5 | Kovar | +2.8% | O |
| 510 | Pt | VD | 0.5 | Kovar | +2.5% | O |
| 511 | Pt | VD | 0.5 | Kovar | +2.7% | O |
| 512 | Pt | VD | 0.5 | Kovar | +2.4% | O |
| 513 | Au | Plating | 1 | 42Alloy | +1.5% | O |
| 514 | Pd | Plating | 1 | 42Alloy | +1.7% | O |
| 515 | Ni | Plating | 1 | 42Alloy | +2.9% | O |
| 516 | Kovar | Foil brazing | 50 | 42Alloy | +1.1% | O |
| 517 | 42Alloy | Foil brazing | 50 | 42Alloy | +1.5% | O |
| 518 | Kovar | Spraying | 60 | 42Alloy | +1.3% | O |
| 519 | 42Alloy | Spraying | 60 | 42Alloy | +1.7% | O |
| 520 | — | — | — | 42Alloy | +2.8% | O |
| 521 | — | — | — | 42Alloy | +2.7% | O |
| 522* | Au | VD | 0.5 | 42Alloy | >+30%** | X |
| 523* | Pt | VD | 0.5 | 42Alloy | >+30%** | X |
| 524* | Pt | VD | 0.5 | 42Alloy | >+30%** | X |

μ: coefficient of thermal expansion over temperature range of 30 to 500° C., expressed in unit of × $10^{-7}$/deg.
*comparison
**1,000 hours Sample No. 501 was examined for ohmic contact after it was kept at 500° C. for 5,000 hours. The results are shown in FIG. 10 where voltage E (in volt) is plotted as a function of current I (in ×$10^{-7}$ ampere).

Sample No. 524 showed a resistance reduction of more than 15% due to foaming during glass encapsulation.

The effectiveness of the present invention is evident from these data.

EXAMPLE 6

A composite sintered body of a composition shown in Table 4 having a diameter of 3 inches and a thickness of 0.5 mm was prepared by hot press sintering a corresponding compact under the conditions shown in Table 4.

The volume ratio of $SiC/Al_2O_3$ and the ratio (Da/Dt) of actual density (Da) to theoretical density (Dt) of the sintered body are also reported in Table 4. Calculation is the same as described in Example 1.

The following electrode layer was formed on either surface of the composite sintered body, obtaining a wafer.

Electrode layer E1

A conductive paste having a viscosity of 240 Pa.s was prepared by mixing 98 parts by weight of powder conductive material, 62PT-38Au alloy having a particle size of 0.5 μm, 2 parts by weight of powder oxide, CuO having a particle size of 0.5 μm, and suitable amounts of a binder, ethyl cellulose and a solvent, butyl cellulose.

It is to be noted that 62Pt-38Au is an alloy consisting of 62% by weight of Pt and 38% by weight of Au, and the same applies to the following alloys.

The conductive paste was applied to either surface of the composite sintered body by a printing technique and baked for 2 hours at 95° C. in an argon atmosphere to form electrode layers. The thickness of the electrode layers is shown in Table 4.

Electrode layer E2

Electrode layer E2 was prepared by the same procedure as electrode layer E1 except that the conductive material used was 65Pd-35Au.

Electrode layer E3

Electrode layer E3 was prepared by the same procedure as electrode layer E1 except that the conductive material used was Au.

Electrode layer E4

Electrode layer E4 was prepared by the same proceudre as electrode layer E1 except that the conductive material used was 5iAu-24Pt-24Pd. Baking was carried out for 2 hours at 1,000° C. in an argon atmosphere.

Electrode layer E5

Electrode layer E5 was prepared by the same procedure as electrode layer E1 except that the conductive material used was 24Pt-12Pd-64Ag. Baking was carried out for 2 hours at 900° C. in an argon atmosphere.

Electrode layer E6

A conductive paste having a viscosity of 240 Pa.s was prepared by mixing 98 parts by weight of powder conductive material, 62Pt-38Au alloy having a particle size of 0.5 μm, 1.8 parts by weight of powder oxide, CuO having a particle size of 0.5 μm, 0.2 parts by weight of lead borosilicate glass, and suitable amounts of a binder and a solvent.

The conductive paste was applied to either surface of the composite sintered body by a printing technique and baked for 2 hours at 920° C. in an argon atmosphere to form electrode layers.

Electrode layer E7

Electrode layer E7 was prepared by the same procedure as electrode layer E6 except that 1.2 parts by weight of CuO and 0.8 parts by weight of lead borosilicate glass were used and the baking temperature was 900° C.

The wafere was then cut by means of a diamond blade of a peripheral slicing machine into square thermistor chips of 0.75 mm by 0.75 mm.

To the thermistor chip leads of Kovar having a diameter of 0.3 mm and a length of 65 mm were bonded with the same glass fritless gold paste as electrode layer E3.

The lead-bonded chip was placed in a borosilicate glass tube having a diameter of 2.5 mm and a length of 4 mm and encapsulated therewith by heating at 85° C. in an argon gas atmosphere. There was obtained a thermistor element as shown in FIG. 2. The element was aged. In this way, thermistor element Nos. 601 to 610 were fabricated.

These samples were examined for the following properties.

(1) Resistance change

The resistance of a sample was measured before and after it was kept at 500° C. for 5,000 hours. The percent resistance change is represented by $$\Delta R/R0 \times 100\%$$

wherein R0 is an initial resistance and ΔR is a change of resistance.

(2) Ohmic contact

The current and voltage applied across a sample was measured before and after it was kept at 500° C. for 5,000 hours, to examine any deterioration of ohmic contact. The sample is rated by O or X.

O: unchanged

X: deteriorated (3) Bond strength

A bond strength was measured by a peel test. The sample is rated by O or X in terms of a force required for peeling.

X: 0 to 0.25 kg-f/mm$^2$

O: more than 0.25 kg-f/mm$^2$

The results are shown in Table 4.

Additional thermistor elements, sample Nos. 611 to 616, were fabricated by the same procedure as above except that the electrode layer was replaced by the following electrode layers.

ELECTRODE LAYER E8

A conductive paste having a viscosity of 240 Pa.s was prepared by following the same procedure as electrode layer E1 except that 98.8 parts by weight of powder conductive material, 62Pt-38Au alloy having a particle size of 0.5 μm and 1.2 parts by weight of lead borosilicate glass and the baking temperature was 850° C.

ELECTRODE LAYER E9

Electrode layer E9 was prepared by the same procedure as electrode layer E8 except that the lead borosilicate glass was replaced by 1.2 parts by weight of borosilicate glass and the baking temperature was 900° C.

ELECTRODE LAYER E10

Electrode layer E10 was prepared by the same procedure as electrode layer E8 except that 2.0 parts by weight of borosilicate glass was used and the baking temperature was 880° C.

These samples were examined for the same properties as the previous samples. The results are shown in Table 4.

The lead-bonded chip was placed in a glass tube having a diameter of 2.5 mm and a length of 4 mm formed of alkaline earth metal-containing barium borosilicate glass having a glass transition temperature of 650° C. and a working temperature of 942° C. The chip was encapsulated therewith by heating at 800° C. in an argon gas atmosphere. There was obtained a thermistor element as shown in FIG. 2. The element was aged. In this way, thermistor element sample Nos. 701 and 702 were fabricated.

TABLE 4

| Sample No. | Thermistor chip Composition (wt. %) | Sintering temp. (°C.) | Pressure (kg/cm²) | $SiC/Al_2O_3$ | Da/Dt | Electrode layer Type | Thickness (μm) | ΔR/R0 | Ohmic contact | Bond strength |
|---|---|---|---|---|---|---|---|---|---|---|
| 601 | $Al_2O_3$ 86/$B_4C$ 14 | 1650 | 200 | 0 | >95% | E1 | 15 | <1.5 | O | O |
| 602 | $Al_2O_3$ 86/$B_4C$ 14 | 1650 | 200 | 0 | >95% | E1 | 25 | <1.5 | O | O |
| 602 | $Al_2O_3$ 86/$B_4C$ 14 | 1650 | 200 | 0 | >95% | E2 | 15 | <2 | O | O |
| 604 | $Al_2O_3$ 86/$B_4C$ 14 | 1650 | 200 | 0 | >95% | E3 | 15 | <2 | O | O |
| 605 | $Al_2O_3$ 86/$B_4C$ 14 | 1650 | 200 | 0 | >95% | E4 | 15 | <2 | O | O |
| 606 | $Al_2O_3$ 86/$B_4C$ 14 | 1650 | 200 | 0 | >95% | E5 | 15 | <2.5 | O | O |
| 607 | $Al_2O_3$ 78/$B_4C$ 11/SiC 11 | 1700 | 200 | 0.175 | >95% | E1 | 15 | <1.5 | O | O |
| 608 | $Al_2O_3$ 78/$B_4C$ 11/SiC 11 | 1700 | 200 | 0.175 | >95% | E2 | 15 | <2 | O | O |
| 609 | $Al_2O_3$ 86/$B_4C$ 14 | 1650 | 200 | 0 | >95% | E6 | 15 | <2.5 | O | O |
| 610 | $Al_2O_3$ 86/$B_4C$ 14 | 1650 | 200 | 0 | >95% | E7 | 15 | <3 | O | O |
| 611 | $Al_2O_3$ 86/$B_4C$ 14 | 1650 | 200 | 0 | >95% | E8 | 15 | — | — | X |
| 612 | $Al_2O_3$ 86/$B_4C$ 14 | 1650 | 200 | 0 | >95% | E9 | 15 | — | — | X |
| 613 | $Al_2O_3$ 86/$B_4C$ 14 | 1650 | 200 | 0 | >95% | E10 | 15 | — | — | X |
| 614 | $Al_2O_3$ 86/$B_4C$ 11/SiC 11 | 1700 | 200 | 0.175 | >95% | E8 | 15 | — | — | X |
| 615 | $Al_2O_3$ 78/$B_4C$ 11/SiC 11 | 1700 | 200 | 0.175 | >95% | E9 | 15 | — | — | X |
| 616 | $Al_2O_3$ 78/$B_4C$ 11/SiC 11 | 1700 | 200 | 0.175 | >95% | E10 | 15 | — | — | X |

Sample Nos. 611 to 616 could not be processed into elements because exfoliation occurred upon cutting by a dicing saw. Sample Nos. 611 to 616 had a low bond strength because of foaming at the interface between the thermistor chip and the electrode layers.

The effectiveness of the present invention is evident from these data.

EXAMPLE 7

A composite sintered body of a composition shown in Table 5 having a diameter of 3 inches and a thickness of 0.5 mm was prepared by hot press sintering a corresponding compact under the conditions shown in Table 5.

The volume ratio of $SiC/Al_2O_3$ and the ratio (Da/Dt) of actual density (Da) to theoretical density (Dt) of the sintered body are also reported in Table 5. Calculation is the same as described in Example 1.

An electrode layer of nickel was formed on either surface of the composite sintered body to a thickness of 0.5 μm by vacuum deposition. A second electrode layer of platinum having a thickness of 1.0 μm was formed on the nickel layer by plating, obtaining a wafer.

The wafer was then cut by means of a diamond blade of a peripheral slicing machine into square thermistor chips of 0.75 mm by 0.75 mm.

To the thermistor chip leads of Kovar having a diameter of 0.3 mm and a length of 65 mm were bonded by a parallel gap welding technique under the following conditions.

AC voltage: 0.60 to 0.83 volts
Time: 30 to 40 msec.
Gap distance: 0.20 mm
Applied pressure: 2.8 kg.

These samples were examined for the following properties.

(1) Resistance change before and after glass encapsulation
(2) Resistance change before and after high-temperature storage The resistance of a sample was measured both before and after glass encapsulation and both before and after it was kept at 500° C. for 5,000 hours. The percent resistance change is represented by $$\Delta R/R0 \times 100\%$$

wherein R0 is an initial resistance and ΔR is a change of resistance.

The results are shown in Table 5.

For comparison purposes, sample No. 703 was fabricated by repeating the same procedure as above except that the glass used for encapsulation was 7056 Glass having a glass transition temperature of 500° C. and a working temperature of 1058° C. (manufactured by Corning Glass Works). In this case, encapsulation was carried out at 950° C. in an argon atmosphere because the glass could not sealed at the same temperature of 800° C. as above.

Sample No. 704 was fabricated by repeating the same procedure as above except that the glass used for encapsulation was NEGLG-16 Glass having a glass transition temperature of 420° C. and a working temperature of 820° C. (manufactured by Nihon Denki Glass K.K.) and encapsulation was carried out at 750° C. in an argon atmosphere.

These samples were measured for the same properties as above. The results are shown in Table 5.

TABLE 5

| Sample No. | Thermistor chip Composition (wt. %) | Sintering temp. (°C.) | Pressure ($kg/cm^2$) | $SiC/Al_2O_3$ | Da/Dt | Resistance change ΔR/RO(%) After encapsulation | After high-temperature storage |
|---|---|---|---|---|---|---|---|
| 701 | $Al_2O_3$ 86/$B_4C$ 14 | 1650 | 200 | 0 | >95% | <1.0 | <1.0 |
| 702 | $Al_2O_3$ 78/$B_4C$ 11/SiC 11 | 1700 | 200 | 0.175 | >95% | <1.0 | <1.0 |
| 703 | $Al_2O_3$ 86/$B_4C$ 14 | 1650 | 200 | 0 | >95% | >30 | <3.0 |
| 704 | $Al_2O_3$ 86/$B_4C$ 14 | 1650 | 200 | 0 | >95% | <1.0 | failure (unmeasurable) |

Sample No. 703 which used the encapsulating glass having a higher working temperature could be encapsulated only at a high sealing temperature, which adversely affected the thermistor chip and leads, resulting in an increased resistance.

For sample No. 704, the encapsulating glass was deformed in the high-temperature storage test and thus measurement of resistance was impossible.

Further samples were fabricated by repeating the foregoing procedure except that the bonding of Kovar leads was carried out using a glass fritless gold paste. The results were equivalent to those of corresponding sample Nos. 701 to 702.

The effectiveness of the present invention is evident from these data.

EXAMPLE 8

Aluminum oxide $Al_2O_3$ having an average grain size of 1.2 μm and a purity of at least 99.9% by weight, and boron carbide $B_4C$ having an average grain size of 1.2 μm and a purity of at least 98% by weight were weighed in amounts as reported in Table 6. An additive having an average grain size of 0.1 to 5 μm and a purity of at least 99.5% by weight as reported in Table 6 was added to the mixture, which was wet milled for 20 hours in a ball mill along with acetone.

The slurry was dried and granulated. A mold was filled with the granules. The compact was hot press sintered in an argon atmosphere or vacuum of $10^{-2}$ Torr at a temperature of 1,400° to 1,700° C. and a press pressure of 200 to 300 $kg/cm^2$.

The mold was cooled to take ou the composite sintered body having a diameter of 3 inch and a thickness of 0.5 mm. Table 6 also shows the volume ratio of $Al_2O_3/SiC$ and density ratio Da/Dt which were obtained by the same methods as in Example 1.

An electrode layer of nickel having a thickness of 0.5 μm was formed on either surface of the sintered body by vacuum deposition. A second electrode layer of platinum having a thickness of 1.0 μm was formed on the nickel layer by plating, obtaining a wafer.

The wafer was cut into square thermistor chips of 0.75 by 0.75 mm by a diamond blade of a peripheral slicing machine.

Leads of Kovar having a diameter of 0.3 mm and a length of 65 mm were bonded to the thermistor chip by a parallel gap welding technique under the following conditions.

AC voltage: 0.60 to 0.83 volts
Time: 30 to 40 msec.
Gap distance: 0.20 mm
Applied pressure: 2.8 kg.

The chip was encapsulated with glass and aged as in Example 1. In this way, 2500 samples were prepared for each composition.

The samples were measured for resistivity. An average resistivity ($\bar{\rho}$) of 2500 samples is calculated. A coefficient of variation of resistivity (CV) which is a standard deviation divided by average resistivity ($\sigma/\bar{\rho}$) is reported in Table 6.

TABLE 6

| Sample No. | Composition $Al_2O_3$ | $B_4C$ | SiC | Additive Type | Amount* | Sintering temp. (°C.) | Da/Dt | CV @ 50° C. |
|---|---|---|---|---|---|---|---|---|
| 801 | 86 | 14 | 0 | — | — | 1600 | >95% | 12.5 |
| 802 | 86 | 14 | 0 | $MgCO_3$ | Mg 0.2 | 1600 | >95% | 3.1 |
| 803 | 86 | 14 | 0 | $CaCO_3$ | Ca 0.2 | 1600 | >95% | 3.8 |
| 804 | 86 | 14 | 0 | $SrCO_3$ | Sr 0.2 | 1600 | >95% | 5.6 |
| 805 | 86 | 14 | 0 | $BaCO_3$ | Ba 0.2 | 1600 | >95% | 5.2 |
| 806 | 86 | 14 | 0 | $Y_2O_3$ | Y 0.2 | 1600 | >95% | 4.5 |
| 807 | 86 | 14 | 0 | $TiO_2$ | Ti 0.2 | 1600 | >95% | 3.2 |
| 808 | 86 | 14 | 0 | $ZrO_2$ | Zr 0.2 | 1600 | >95% | 4.3 |
| 809 | 86 | 14 | 0 | $Fe_2O_3$ | Fe 0.2 | 1600 | >95% | 4.0 |
| 810 | 86 | 14 | 0 | $CeO_3$ | Ce 0.2 | 1600 | >95% | 4.2 |
| 811 | 86 | 14 | 0 | $Cr_2O_3$ | Cr 0.2 | 1600 | >95% | 10.5 |
| 812 | 86 | 14 | 0 | $WO_2$ | W 0.2 | 1600 | >95% | 9.7 |
| 813 | 86 | 14 | 0 | $SiO_2$ | Si 0.2 | 1600 | >95% | 18.7 |

*% by weight of elemental metal based on the total weight of $Al_2O_3$—$B_4C$—SiC system As is evident from the data of Table 6, the samples within the scope of the present invention are excellent.

Obviously, numerous modifications and variations of the present invention are possible in light of the above teachings. It is therefore to be understood that within the scope of the apended claims, the invention may be practiced otherwise than as specifically described herein.

We claim:

1. A thermistor material in the form of a sintered body comprising (A) a matrix comprising at least one oxide selected from the group consisting of oxides of aluminum, of silicon, and of the elements magnesium, calcium, strontium and barium, and (B) a conductive path forming substance comprising at least one carbide selected from the group consisting of silicon carbide and boron carbide, wherein the volume ratio of silicon carbide to the matrix is up to about 1.24, and wherein the weight ratios of the matrix, silicon carbide and boron carbide are within the region defined by boundary lines joining corner coordinates (x, y, z) on a triangular plot, where x, y, z are the weight percent respectively of $Al_2O_3$, SiC and $B_4C$, when the matrix is $Al_2O_3$ and the corner coordinates are (95,0,5), (5,0,95), (50,50,0) and (95,5,0) or by the corner coordinates ($Ay\rho m/\rho a$, Ay, Az) when the matrix is different from $Al_2O_3$, where $\rho m$ is the theoretical density of the matrix, $\rho a$ is the theoretical density of $Al_2O_3$, and A is a value such that $A \times \rho m/\rho a + Ay + Az = 100$, and the variables x, y, z have the preceding values specified for the corner coordinates when the matrix is $Al_2O_3$.

2. The thermistor material of claim 1 wherein the sintered body has a density of at least about 75% of the theoretical density.

3. The thermistor material of claim 1 wherein the matrix further comprises at least one of the oxides of elements belonging to Group 4A in the Periodic Table such that the volume ratio of the Group 4A element oxide to the silicon carbide and boron carbide is up to about ½.

4. The thermistor material of claim 1 which further comprises an element belonging to Group 2A in the Periodic Table in elemental or carbide form.

5. The thermistor material of claim 4 wherein the Group 2A element in elemental or carbide form is present in an amount of from about 0.01 to about 10% by weight of the themistor material calculated in elemental form.

6. The thermistor material of claim 1 which further comprises an element belonging to Group 3A in the Periodic Table.

7. The thermistor material of claim 6 wherein the Group 3A element is present in elemental, oxide or carbide form.

8. The thermistor material of claim 7 wherein the Group 3A element in elemental, oxide or carbide form is present in an amount of about 0.01 to about 10% by weight of the themistor material calculated in elemental form.

9. The thermistor material of claim 1 which further comprises an element belonging to Group 4A in the Periodic Table in elemental or carbide form in an amount of about 0.01 to about 10% by weight of the themistor material calculated in elemental form.

10. The thermistor material of claim 1 which further comprises iron in elemental, oxide or carbide form.

11. The thermistor material of claim 10 wherein iron in elemental, oxide or carbide form is present in an amount of about 0.01 to about 10% by weight of the themistor material calculated in elemental form.

12. A thermistor element comprising a thermistor chip formed of a thermistor material as set forth in any one of claims 1 to 11.

* * * * *